US005182595A

United States Patent [19]

Fukuchi et al.

[11] Patent Number: 5,182,595

[45] Date of Patent: * Jan. 26, 1993

[54] IMAGE FORMING APPARATUS HAVING AN DISMOUNTABLE PROCESS CARTRIDGE

[75] Inventors: Masakazu Fukuchi; Shizuo Morita; Satoshi Haneda; Hisao Satoh; Tadayoshi Ikeda, all of Hachioji, Japan

[73] Assignee: Konica Corporation, Tokyo, Japan

[ * ] Notice: The portion of the term of this patent subsequent to Jun. 30, 2009 has been disclaimed.

[21] Appl. No.: 732,580

[22] Filed: Jul. 18, 1991

[30] Foreign Application Priority Data

Jul. 26, 1990 [JP] Japan ..... 2-200786
Jul. 26, 1990 [JP] Japan ..... 2-200787
Jul. 26, 1990 [JP] Japan ..... 2-200788

[51] Int. Cl.[5] ..... G03G 15/00

[52] U.S. Cl. ..... 355/200; 271/162; 271/164; 355/205; 355/207; 355/309

[58] Field of Search ..... 355/200, 210, 211, 212, 355/205, 207, 260, 308, 309, 208; 271/162, 164

[56] References Cited

U.S. PATENT DOCUMENTS 4,791,454 12/1988 Takahashi et al. ..... 355/260 X
4,943,828 7/1990 Manabe et al. ..... 355/200
4,963,928 10/1990 Yoshiura ..... 355/210
5,027,152 6/1991 Oda et al. ..... 355/200
5,047,803 9/1991 Kanoto ..... 355/211

FOREIGN PATENT DOCUMENTS 61-279870 12/1986 Japan .
2-230165 9/1990 Japan .

*Primary Examiner*—A. T. Grimley
*Assistant Examiner*—Shuk Y. Lee
*Attorney, Agent, or Firm*—Frishauf, Holtz, Goodman & Woodward

[57] ABSTRACT

A printer having an automatic removable cartridge. The cartridge has at least one of a photoreceptor, a developer, and a cleaner. The cartridge is automatically removed from the printer at a part when an operator opens the upper cover of the printer, or the printer senses an inside paper jam. The operator can remove the cartridge completely from the printer after it is partially removed by the automatic operation. The printer also includes an operating panel or the like to forcefully remove the cartridge from the printer by a command of the operator.

9 Claims, 14 Drawing Sheets

FIG. 12 (a)

| JAMMING LOCATION | PROCESS CARTRIDGE MOVING MEANS | CASSETTE MOVING MEANS |
|---|---|---|
| NO-SHEET SENSOR $S_0$ | | ○ |
| SHEET FEED SENSOR $S_1$ | | ○ |
| TIMING SENSOR $S_2$ | ○ | ○ |
| TRANSFER SENSOR $S_3$ | ○ | |
| SHEET DISCHARGE SENSOR $S_4$ | | |

FIG. 12 (b)

| JAMMING LOCATION | PROCESS CARTRIDGE MOVING MEANS | CASSETTE MOVING MEANS | |
|---|---|---|---|
| NO-SHEET SENSOR $S_0$ | | ○ | |
| SHEET FEED SENSOR $S_1$ | | ○ | |
| TIMING SENSOR $S_2$ | ○ | ○ | ○ |
| TRANSFER SENSOR $S_3$ | ○ | | ○ |
| SHEET DISCHARGE SENSOR $S_4$ | | | ○ |

IMAGE FORMING APPARATUS HAVING AN DISMOUNTABLE PROCESS CARTRIDGE

BACKGROUND OF THE INVENTION

The present invention relates to an image forming apparatus for obtaining picture in an electrophotographic way that a toner image is formed on an image carrier and is transferred onto transfer material. More particularly, it relates to an image forming apparatus for use as a printer, a copying machine, a facsimile machine, or similar machines having a demountable process cartridge provided therein in which the image carrier is integrated with at least one of a developing arrangement and a cleaning arrangement.

Image forming apparatuses, such as printers and copying machines, have advanced to provide more automated functions, component density complications have increased; these higher densities are needed to provide a lighter weight and have higher operating functions.

The image forming apparatuses of transfer type have been substantially improved in its transfer material feeding performance. However, the apparatuses heretofore used have the disadvantage that they cannot be made free of jamming yet. In order to remove the jamming transfer material (hereinafter referred to as the jamming paper), an operator has to open outside doors of the apparatus, and move all of or parts of moving arrangements for feeding the transfer material to make working rooms inside the complicated apparatus so that the operator's hand can reach the jamming paper. Manufacturers have to take in consideration that clearing of the jamming paper can be made easily and readily as it is ordinarily made by the operator having no special skills.

As a typical example of the apparatus for which such a consideration is taken, there have been proposed apparatuses of shutlex type and clamshell type (for example, the Japanese Patent Laid-Open Publication No. 279870/1986). In such apparatuses, a variety of elaborations were made to widen the working area and simplify necessary manipulations, for example, casings could be opened itself to partition a sheet feed route, grips of movable sections in the sheet feed route of the transfer material were colored so that the operator could recognize them easily, a jamming position was indicated on a display, or parts of a transfer arrangement, a sheet feed arrangement, and similar image forming arrangements were assembled as independent units so that any of them could be isolated to clear the sheet feed route.

However, the apparatuses mentioned above have the disadvantage that the operator himself has to move the movable sections to clear the sheet feed route of the transfer material, thereby making the working room. This is troublesome work. The working room obtained for clearing of jamming is too narrow to easily insert a hand into it to remove the jamming paper. To release the sheet feed route, he or she had to search for a position where the jamming paper is. If the sheet feed route is complicated, particularly in a color both-side, high speed, high performance image forming apparatus, he or she had to move a plurality of movable portions at a time to release a plurality of sheet feed routes. He or she was not only confused in shooting the jamming position for a long time, but also might be involved in erroneous manipulations, resulting in some troubles.

The conventional image forming apparatuses have the disadvantage in the workability that as they were ordinarily leveled at around a waste of the operator, he or she had to sit down on his or her kneels or bend his or her body not only to see, but also to clear of the jamming paper.

In any way, as the conventional apparatuses caused the operator himself or herself to move the movable sections to release the sheet feed route, they were not only disadvantageous in the workability, but also might injure him or her or the image carrier if his or her hand had to force or put into narrow spaces.

In order to replace the process cartridge or cassette of the conventional apparatuses, the operator had to pull it out of the apparatus body to a great extent. This work was not only very troublesome, but also needed for him or her to have a mighty force to bring up the heavy process cartridge or cassette which might be in contact with the sheet feed roller or to erroneously drop it down.

In short, the conventional apparatuses are disadvantageous in the simplicity of work and safety when the jamming paper is to be removed or the process cartridge or cassette has to be replaced.

In view of the foregoing, it is a general object of the present invention to provide an improved image forming apparatus which provides wider working space for clearing of jamming paper, allows an operator to easily replace a process cartridge or cartridge, and is superior in the maintainability. More specifically, it is an object of the present invention to provide an improved image forming apparatus for color images having a heavy process cartridge which can be cleared of jamming paper or replaced safely and easily.

SUMMARY OF THE INVENTION

Briefly, as will be described in the first embodiment, the foregoing object is accomplished in accordance with aspects of the present invention by an improved image forming apparatus comprising in combination an image carrier on which an electrostatic latent image is formed; a demountable process cartridge which is integrated with at least one of a developing arrangement and a cleaning arrangement; a process cartridge moving arrangement for moving the process cartridge from a first position where image forming can be made to a second position opposite to an inlet thereof from the first position; an upper cover detection arrangement which can detect release of an upper cover turnably provided on an apparatus body and output a release signal; and a control arrangement for outputting a move signal to the process cartridge moving arrangement on the basis of the release signal.

Also, as described in the second embodiment, the foregoing object is accomplished in accordance with aspects of the present invention by an improved image forming apparatus comprising in combination an image carrier on which an electrostatic latent image is formed; a demountable process cartridge which is integrated with at least one of a developing arrangement and a cleaning arrangement; a process cartridge moving arrangement for moving the process cartridge from a first position where image forming can be made; a demountable cassette for containing transfer material; a cassette moving arrangement for moving the cassette from a position where sheet supply can be made; a jamming detection arrangement for detecting jamming of the transfer material on a sheet feed route of the transfer material and outputting a jamming signal; an upper cover detection arrangement which can detect release of an upper cover provided on an apparatus body and output a release signal; and a control arrangement for outputting a move signal to the process cartridge moving arrangement and the cassette moving arrangement on the basis of the jamming signal and the release signal.

Further, as described in the third embodiment, the foregoing object is accomplished in accordance with aspects of the present invention by an improved image forming apparatus comprising in combination an image carrier on which an electrostatic latent image is formed; a demountable process cartridge which is integrated with at least one of a developing arrangement and a cleaning arrangement; a process cartridge moving arrangement for moving the process cartridge from a first position where image forming can be made; an upper cover releasing arrangement for releasing an upper cover provided on the apparatus body; a jamming detection arrangement for detecting jamming of the transfer material on a sheet feed route of transfer material and outputting a jamming signal; and a control arrangement for outputting a move signal to the process cartridge moving arrangement and a release signal to the upper cover releasing arrangement on the basis of the jamming signal.

BRIEF DESCRIPTION OF THE DRAWINGS

Other objects and advantages of the present invention will further become apparent thereinafter and in the drawings in which:

FIGS. 9(*a*)-1, 9(*a*)-2, 9(*b*)-1, and 9(*b*)-2 are views illustrating an upper cover releasing arrangement.

FIG. 12(*a*) is a chart showing a control for the process cartridge moving arrangement and the cassette moving arrangement with respect to jam occurrence position.

FIG. 12(*b*) is another chart showing a control for the process cartridge moving arrangement and the cassette moving arrangement with respect to jam occurrence position.

DETAILED DESCRIPTION OF THE INVENTION

Figure 1:
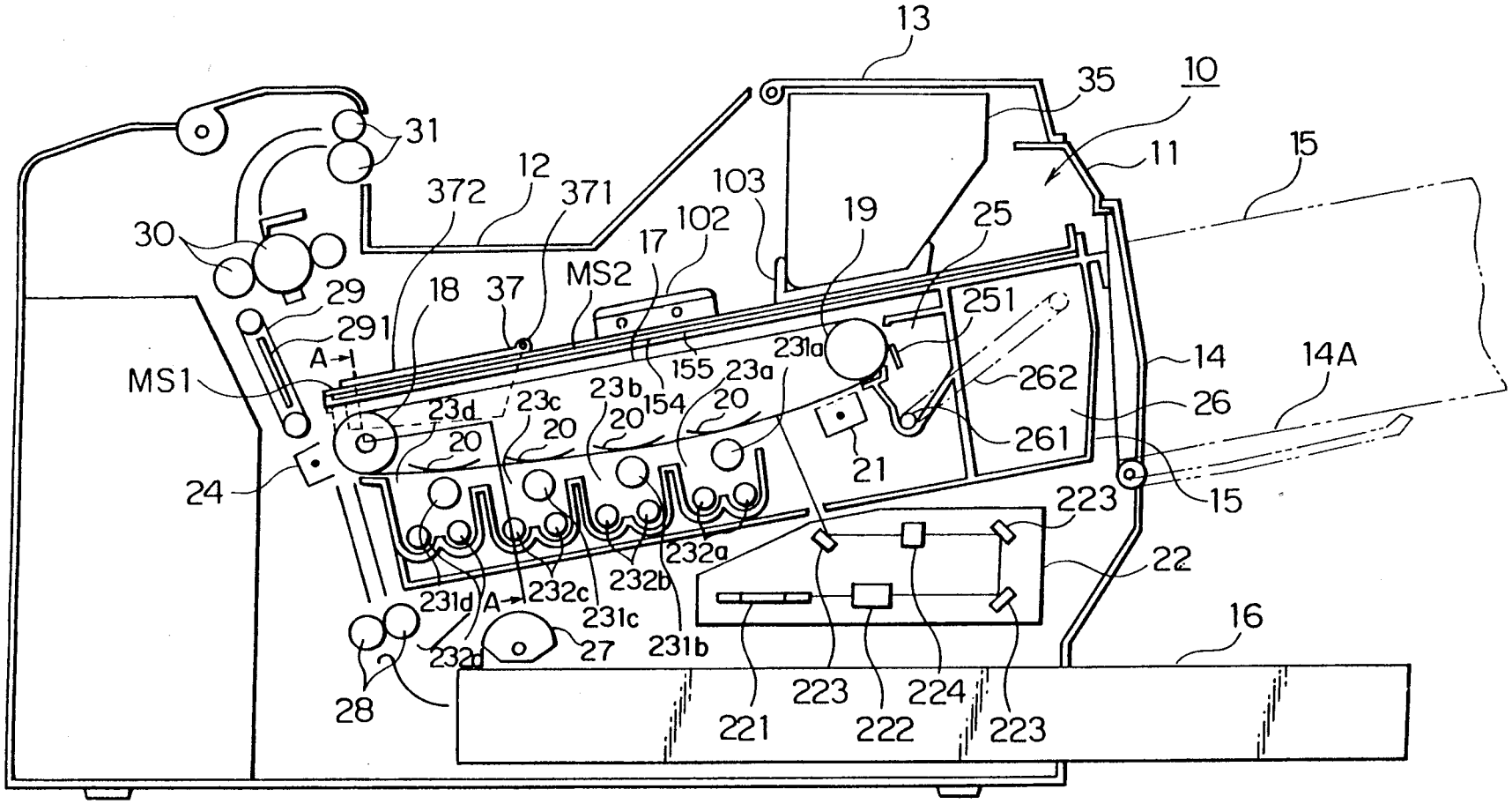
FIG. 1 is a left side view of major sections of a color printer according to the present invention.

Referring now to the figures, a first embodiment of the image forming apparatus of the present invention will be described below. FIG. 1 is a left side view of major sections of a color printer according to the present invention. As shown in the figure, a apparatus body 10 is enclosed by a operation panel 11 in front thereof, an openable upper cover 12, a toner supply cover 13, a front cover 14, and others. It has a demountable process cartridge 15 and a sheet feed cassette 16 provided therein.

In FIG. 1, a photoreceptor belt 17 which is an image carrier has a light sensitive layer coated on surface of flexible belt, being provided between a drive roller 18 and a driven roller 19. The drive roller 18, as will be described later, is revolved by a drive gear engaged with a gear provided in the apparatus body 10 to carry the photoreceptor belt 17 clockwise. A gap retaining member 20 is provided to keep constant gaps between the photoreceptor belt 17 and developing sections 23*a* through 23*d* for forming stable quality images. It should be noted that the first embodiment uses the photoreceptor belt 17 as the image carrier, but the present invention shall not be limited to it, but can use any of the conventional image carriers having the light sensing layer, such as a photoreceptor drum.

There are provided around the photoreceptor belt 17 a charging device 21, an semiconductor laser write system unit 22, the developing sections 23*a* through 23*d*, a transfer arrangement 24, a cleaning arrangement 25, and a waste toner collection box 26.

The charging device 21 is provided to uniformly charge the light sensing layer on the photoreceptor belt 17 with predetermined polarization, being made of any of the conventional chargers, such as a corona charger and a scorotron charger. The scorotron charger has been preferably used for OPC photoreceptor.

The semiconductor laser write stem unit 22 is a semiconductor laser writing system unit which can expose the surface of the photoreceptor belt 17 charged by the charging device 21 to form an electrostatic latent image.

The developing sections 23*a* through 23*d* include a plurality of developing sections containing toners (developers) of different coolers, for example, yellow, magenta, cyan, and black toners. Each of the developing sections 23*a* through 23*d* have developing sleeves 231*a* through 231*d* to keep the predetermined gaps from the photoreceptor belt 17 and stirring screws 232*a* through 232*d* to stir the color toners, respectively. It can develop the latent toner image on the photoreceptor belt 17 in a non-contact development method. The non-contact development method, unlike the contact development method, is preferable for obtaining good color image as it will not injure the toner image formed on the photoreceptor belt 17 and will not prevent the photoreceptor belt 17 from moving. The developing sections 23*a* through 23*d* are not limited to the four color toners for color development as in the embodiment, but can use a single, two, or three color toners. Number of the developing sections needed around the photoreceptor belt 17 is that of the toners.

The transfer arrangement 24 which is made of, for example, a transfer corona discharger can transfer the toner image formed on the photoreceptor belt 17 onto transfer material. It may be replaced by any of the conventional transfer member, such as a transfer drum.

The cleaning arrangement 25 which has a cleaning blade 251 is kept separated from the surface of the photoreceptor belt 17 during image forming process, but is pressed to the surface to clean the photoreceptor belt 17 only during cleaning after transference of the toner image to the transfer material.

A waste toner collection box 26 shown in FIG. 1 collects through a waste toner collection box waste toner collection tube 262 the toner removed from the surface of the photoreceptor belt 17 by the cleaning arrangement 25 with use of a waste toner collection box 261.

In the first embodiment, the above mentioned processing sections, including the photoreceptor belt 17, the charging device 21, the developing sections 23*a* through 23*d* containing the respective toners, the cleaning arrangement 25, and the waste toner collection box 26, which form an image forming unit of the above mentioned color printer, are integrated together to one unit in the process cartridge 15 so that this can be mounted in or demounted from the apparatus body 10. However, the processing sections integrated in the process cartridge 15 may not be limited these, but they should include at least the photoreceptor belt 17 and the developing sections 23*a* through 23*d* or the photoreceptor belt 17 or the cleaning arrangement 25. The other processing sections may be integrated together with them.

The following describes color image forming process carried by the color image forming apparatus constructed as described above.

First, the process cartridge 15 is loaded at a first position where image forming can be made. If a first color image signal fed out of an image reading unit separated from the apparatus body 10 is input to the semiconductor laser write system unit 22, then a semiconductor laser (not shown) of the semiconductor laser write system unit 22 generates laser beam. The laser beam can be revolved and scanned by a polygonal mirror 221 revolved by a drive motor (not shown). It, then, is projected via a f$\theta$t lens 222, a cylindrical lens 224, and three mirrors 223 onto the surface of the photoreceptor belt 17 having uniformly charged to a predetermined level by a charging device 21 in advance to form bright line thereon.

On the other hand, a belt index (not shown) corresponding to a specific position on the photoreceptor belt 17, or a print command signal is received as to a sub-scanning direction. Based on the detected or command signal, a main scanning line is determined to start modulation of the semiconductor laser by an image signal. With the start of scanning, the laser beam is detected by the index sensor (not shown) as to the main scanning direction. Based on the detected signal, the first color image signal is started to modulate the semiconductor laser. The modulated laser beam is made to scan on the surface of the photoreceptor belt 17. The main scanning by the laser beam and the sub-scanning by the movement of the photoreceptor belt 17 can form a latent image corresponding to the first color on the surface of the photoreceptor belt 17. The latent image is developed by the developing section 23*a* of the developing assembly containing the yellow toner corresponding the first color to form an yellow toner image on the surface of the photoreceptor belt 17. After this, the photoreceptor belt 17 is made to pass under the cleaning blade 251 separated from the surface thereof while holding the yellow toner image thereon, and enters a second color image forming process.

That is, the photoreceptor belt 17 having the yellow toner image formed thereon is charged by the charging device 21 again. A second color image signal is input to the semiconductor laser write system unit 22, and is written onto the surface of the photoreceptor belt 17 to form a latent image as for the first color image signal. The latent image is developed by the developing section 23*b* containing the magenta toner as a second color. The magenta toner image is formed under existence of the yellow toner image formed already.

Similarly, a latent image formed by a third color image signal is developed by the developing section 23*c* containing cyan toner to form cyan toner image. A latent image formed by a fourth color image signal is developed by the developing section 23*d* containing black toner to form black toner image. These toner images are registered on the surface of the photoreceptor belt 17 to form a color toner images thereon.

The developing sleeves 231*a* through 231*d* of the developing sections 23*a* through 23*d* have a dc and/or ac bias applied thereto, which can make a non-contact inversion development (jumping development) on the photoreceptor belt 17 substrate of which is grounded. It should be noted that the non-contact development method can use either one or two component developing agents. With use of the one component developing agent, no separate toner hopper is needed, allowing smaller construction of the apparatus. The developing method using the two component developing agents, however, is more preferable in color reproduction than that as it provides higher development stability.

As described above, the color toner image formed on the surface of the photoreceptor belt 17 is transferred to transfer material supplied from the sheet feed cassette 16 by a sheet feed roller 27 as synchronized in time with the color toner image by a timing roller 28. The transference is made by the transfer arrangement 24 which applies a high voltage of polarity opposite to that of the toner.

The transfer material having the color toner image transferred so far is securely separated from the photoreceptor belt 17 which abruptly changes its moving direction along with the drive roller 18 of small curvature, and is carried up by a carrying belt 29. A suction device 291 of the carrying belt 29 can suck the transfer material to securely carry up. The transfer material then has the toners melted and solidified by a fixing roller 30, and is discharged out by a sheet discharge roller 31 onto the operation panel 11 which also serves as discharged paper tray.

On the other hand, the photoreceptor belt 17 having the transference of the color toner image to the transfer material completed is further carried clockwise, and has the remaining toner removed by the cleaning blade 251 of the cleaning arrangement 25 pressed thereto to clean. After the cleaning, the cleaning blade 251 is separated from the photoreceptor belt 17 again. The operation enters new image forming process.

In turn, the following describes about jamming detection sensors S1 through S4. In FIG. 1, these devices are photosensors which are provided on the transport route for the transfer material. They can detect presence or absence or passing of the transfer material. Based on the presence or absence of the transfer material detected by the jamming detection sensors S1 through S4, a jamming determination unit detects a jam. The jamming determination unit can detect the jam in the conventional way of determining the jam if the transfer material cannot be detected in a predetermined time or if it is being detected for longer period than predetermined. The jamming detection sensors S1 through S4 detect whether the transfer material is supplied from the sheet feed cassette 16, whether it is securely fed by the timing roller 28, whether it is securely separated after the transference of the toner image, and whether it is securely discharged by the sheet discharge roller 31, respectively.

The jamming detection sensors S1 through S4 may not be limitatively arranged as in the first embodiment. Additional jam detection sensors may be provided to detect, for example, whether the transfer material is wound around the fixing roller. A S0 is a sensor which can presence or absence of the transfer material in the sheet feed cassette 16 when this is loaded in the apparatus body 10. The jamming detection sensors S1 through S4 and the S0 may not be reflection type photocouplers as in the embodiment, but transmission type photocouplers. These can be further replaced by usual sensors, such as non-contact lead switches or contact microswitches.

In turn, the following describes about a drive system for the process cartridge 15, another drive system for moving the process cartridge 15, and the other drive system for moving the sheet feed cassette 16 by reference to FIGS. 2 through 6.

Figure 2:
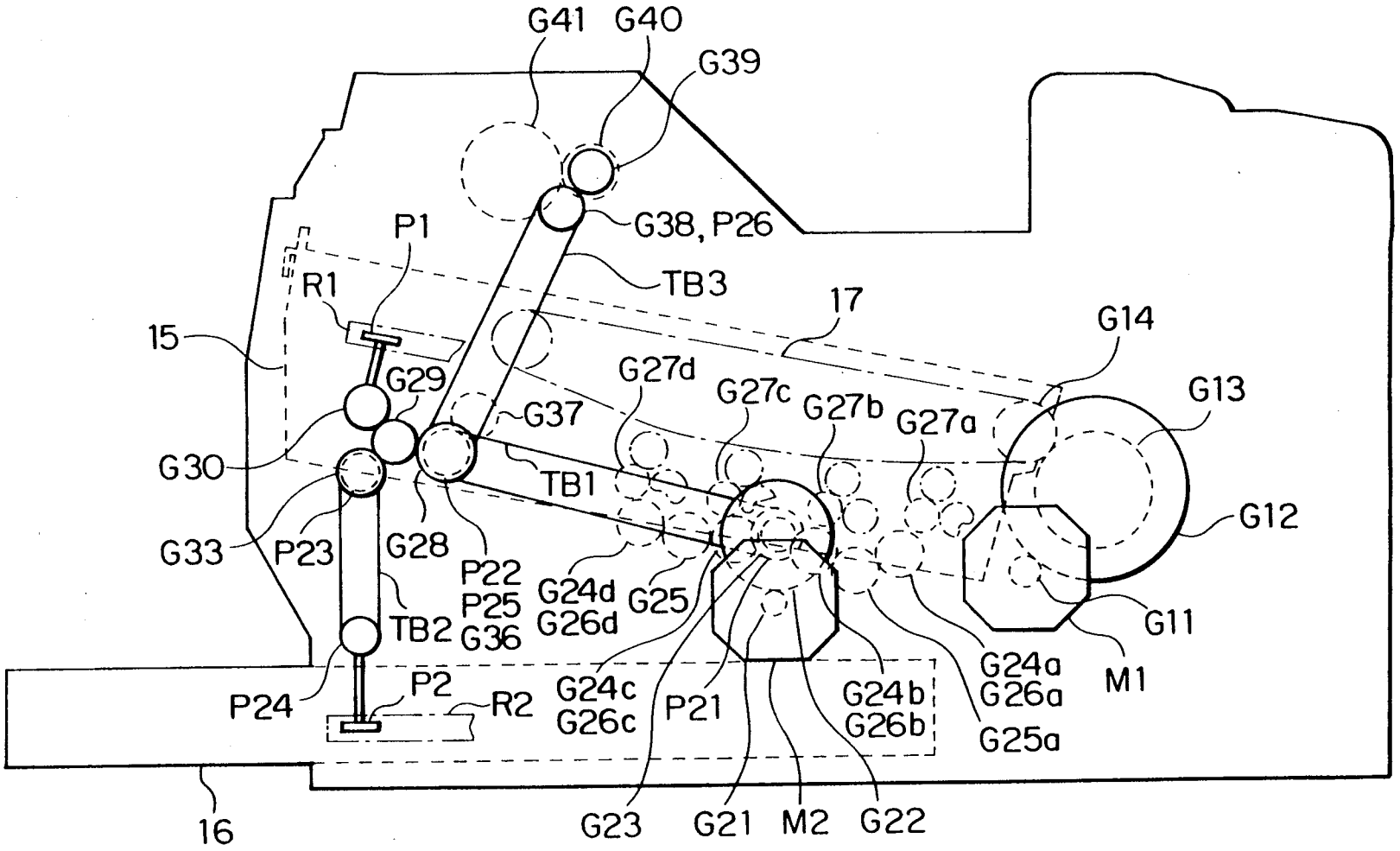
FIG. 2 is a right side view of the drive system of the present invention

FIG. 2 is a right side view of the drive system for the process cartridge 15, the drive system for moving the process cartridge 15, and the drive system for moving the sheet feed cassette 16. The drive operations are made by two motors M1 and M2.

First, the drive system for the photoreceptor belt 17 uses the motor M1. A gear G12 is arranged so as to engage with a gear G11 on a shaft of the motor M1. If the process cartridge 15 is at a position at which image forming can be made, a gear G14 coaxially provided on the drive roller 18 for carrying the photoreceptor belt 17 is engaged with a gear G13 which is revolved together with the gear G12. In other words, revolution of the motor M1 is transmitted through the gear G11, the gear G12, and gear G13 to the gear G14 to adjust its speed, and also revolves the drive roller 18 together with the gear G14 counterclockwise in the figure to carry the photoreceptor belt 17.

Figure 3:
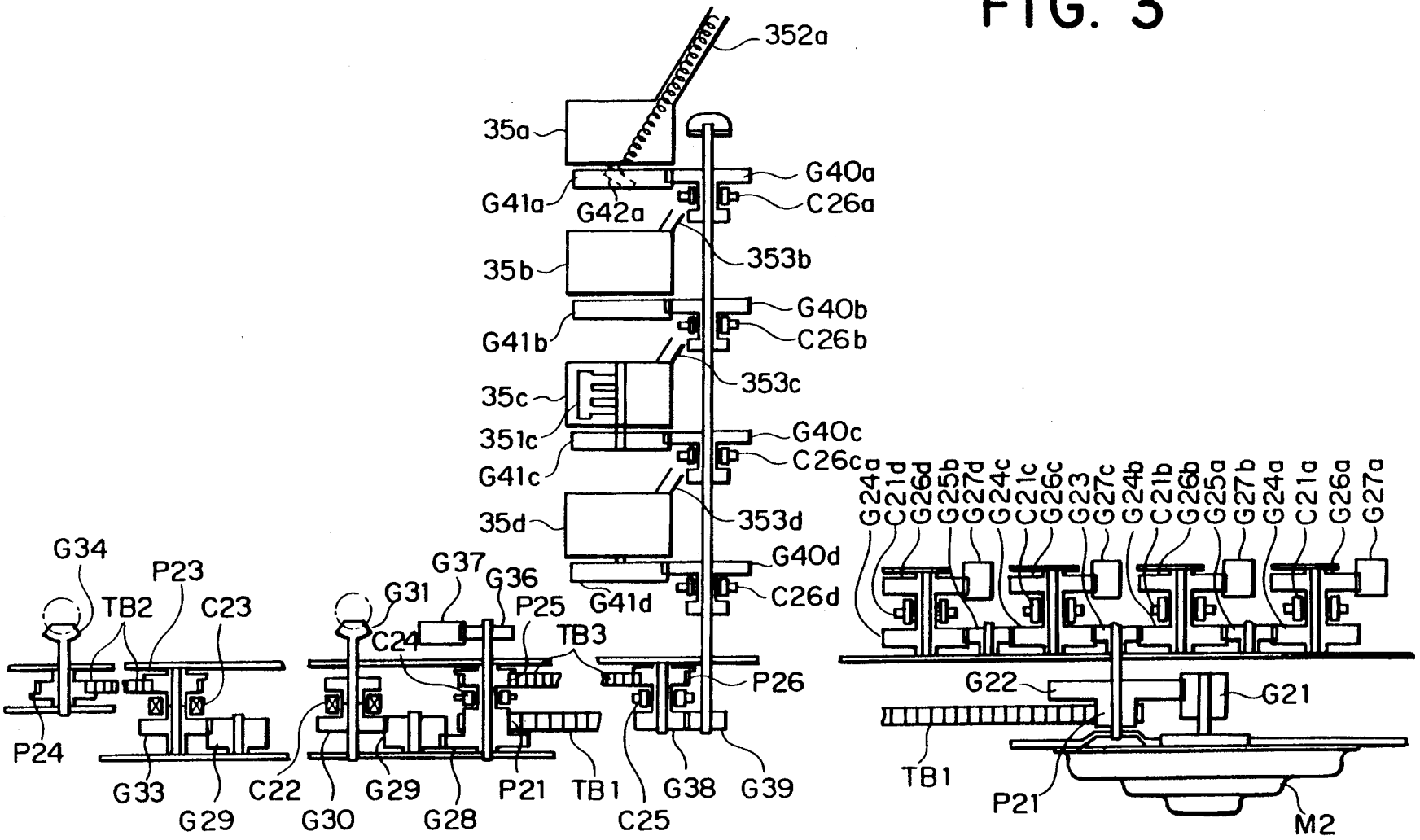
FIG. 3 is plan views illustrating a process cartridge moving drive system and a cassette moving drive system.
Figure 4:
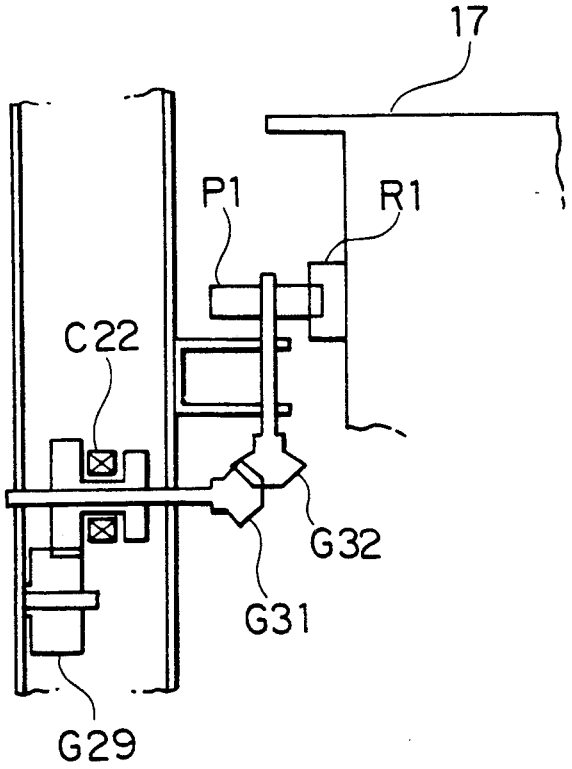
FIG. 4 is a view for a major section illustrating the process cartridge moving drive system.
Figure 5:
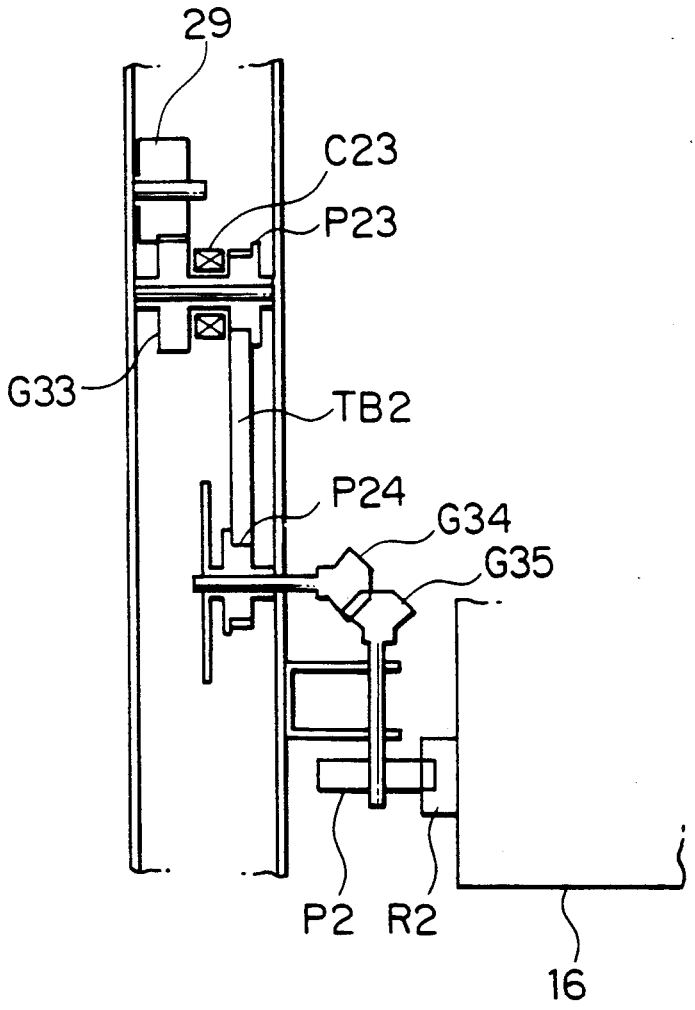
FIG. 5 is a view for a major section illustrating the cassette moving drive system.

In turn, the following describes the developing sections 23*a* through 23*d*, the toner hopper 35, and the drive system for the moving arrangements for the process cartridge 15 and the sheet feed cassette 16 by reference to FIGS. 2 and 3.

The drive system uses the motor M2. Revolution of the motor M2 is transmitted through a gear G21 on the motor M2 to a gear G22, and also is transmitted to a gear G23 coaxially provided on the gear G22 to drive the developing sections 23*a* through 23*d*.

First, the following describes a drive system for the developing sections 23*a* through 23*d*.

The revolution of the motor M2 transmitted to the gear G23 is transmitted to a gear G24*b* and a gear G24*c*, and also is transmitted through a gear G25*a* and a gear G25*b* to a gear G24*a* and a gear G24*d*. There are further arranged gears G26*a* through G26*d* coaxially with the gears G24*a* through G24*d* so as to engage with G27*a* through G27*d* provided in the process cartridge 15 through spring clutches C21*a* through C21*d* of open type to make revolution transmission in only one direction when the process cartridge 15 is at the position at which the image forming can be made. The revolution transmitted to the gears G27*a* through G27*d* is transmitted through gears provided on the process cartridge 15 to the developing sleeves 231*a* through 231*d* and the stirring screws 232*a* through 232*d* to drive the developing unit. In other words, the revolution of the motor M2 is transmitted through the gear G21, the gear G22, and the gear G23 to the gear G24*b* and the gear G24*c*, and further is transmitted through the gear G25*a* and the gear G25*b* to the gear G24*a* and the gear G24*b*. It also is connected with the clutches to transmitted to the gears G27*a* through G27*d* to drive the developing sections 23*a* through 23*d* as necessary. Of the developing sections 23*a* through 23*d*, only the developing section corresponding to the particular color being image formed should be driven, and the developing sections 23*a* through 23*d* should not be driven if the process cartridge 15 or the sheet feed cassette 16 is moved as will be described later. For the purpose, pawls of cams (not shown) touching ratchets (not shown) of the spring clutches C21*a* through C21*d* are shifted in phase, and a step motor (not shown) should be provided to control for selection of one of five positions, including the four cam positions and an additional position to which no clutches can be connected. For example, the four cam pawls corresponding to the respective clutches should be coaxially shifted by 72 degrees each, and the step motor should be turned every 72 degrees so that only one of the developing sections 23*a* through 23*d* can be driven or none of them can be driven.

In turn, the following describes the moving arrangement for the process cartridge 15.

The revolution of the motor M2 transmitted to the gear G22 is transmitted through a pulley P21 revolving together with the gear G22 and a timing belt TB1 to a pulley P22, and also is transmitted to a gear G29 engaged with a gear G28 revolving together with the pulley P22. The revolution of the motor M2 transmitted to the gear G29 is further transmitted to a gear G30 engaged with the gear G29. The revolution also is transmitted through an electromagnetic clutch C22 to a gear G31 as necessary. The gear G31 and the gear G32 which are intersecting axis gears can transmit the revolution from the gear G31 to a pinion P1 (see FIG. 4). The pinion P1 can engage with a rack R1 provide on a side of the process cartridge 15. Revolution of the pinion P1 and sliding of the rack R1 move the process cartridge 15 right and left as will be described in detail later.

The following describes the moving arrangement for the sheet feed cassette 16. The revolution of the motor M2 transmitted to the gear G29 is transmitted to a gear 33 engaging with the gear G29. It also is transmitted through a electromagnetic clutch 23 to a pulley P22, through a timing belt TB2 to a pulley P24, and to a gear G34 revolving together with the pulley P24 as needed. The gear G34 and gear G35 which are intersecting axis gears can transmit the revolution from the gear G34 to a pinion P2 (see FIG. 5). The pinion P2 can engage with a rack R2 provide on a side of the sheet feed cassette 16. Revolution of the pinion P2 and sliding of the rack R2 move the sheet feed cassette 16 right and left as will be described in detail later.

The following describes the drive system for the waste toner collection box 26. The revolution of the motor M2 transmitted pulley P22 is transmitted through a C24 of open type to a pulley P25 to the drive system of a waste toner collection box 261.

In the drive system of the waste toner collection box 261, a gear G36 revolving with the pulley P25 engages with a gear G37 provided on a side of the process cartridge 15 to transmit the revolution from the pulley P25 to the waste toner collection box 261. The waste toner collection box 261 carries the toner removed from the photoreceptor belt 17 by the cleaning arrangement 25 through the waste toner collection box waste toner collection tube 262 having a revolving coil spring to the waste toner collection box 26.

In turn, the following describes the drive system for the toner hoppers 35*a* through 35*d*. The revolution of the motor M2 transmitted to the pulley P25 is transmitted through a timing belt TB3 to a pulley P26, through a C25 to a gear G38 as needed, and to a gear G39 engaging with the gear G38. It is further connected with spring clutches C26*a* through C26*d* to revolve gears G41*a* through G41*d* engaged with gears G40*a* through G40*d* revolving together with the gear G39. Toner hopper stirring members 351*a* through 351*d* are revolved together with the gears G41*a* through G41*d* to stir the supply toner in the toner hoppers 35*a* through 35*d* and at the same time, toner supply screws 352*a* through 352*d* coaxially provided with gears G42*a* through G42*d* engaging with the gears G41*a* through G41*d* are revolved to carry the supply toner into the developing sections 23*a* through 23*d* in the process cartridge 15.

The toner hoppers 35*a* through 35*d* are driven accordingly as the developing sections 23*a* through 23*d* are driven. That is, if the developing section corresponding to the color being image formed is driven, only the toner hopper containing the supply toner of the same color can be driven. To control the drive, the spring clutches C26*a* through C26*d* are used, and another step motor and cams (not shown) are used as in controlling the drive of the developing sections.

The first embodiment, as described above, uses the two motors, the motor M1 for the drive system for the photoreceptor belt 17 and the motor M2 for the developing sections 23*a* through 32*d*, the waste toner collection box 261, the toner hopper 35, and the drive system for the moving arrangements for the process cartridge 15 and the sheet feed cassette 16. These drives, however, may be made by a single motor. Or, it need hardly be said that a motor may be provided only for the moving arrangements for the process cartridge 15 and the sheet feed cassette 16 each.

Figure 6:
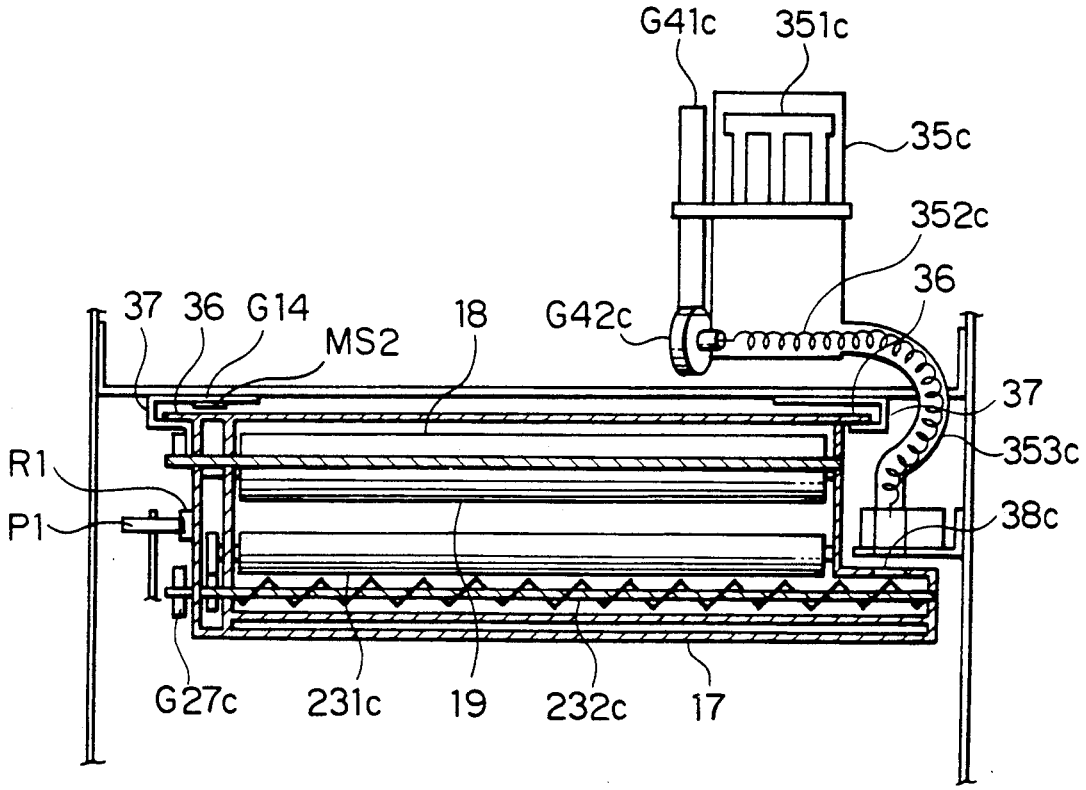
FIG. 6 is a cross-sectional view taken across A—A' in FIG. 1.
Figure 7A:
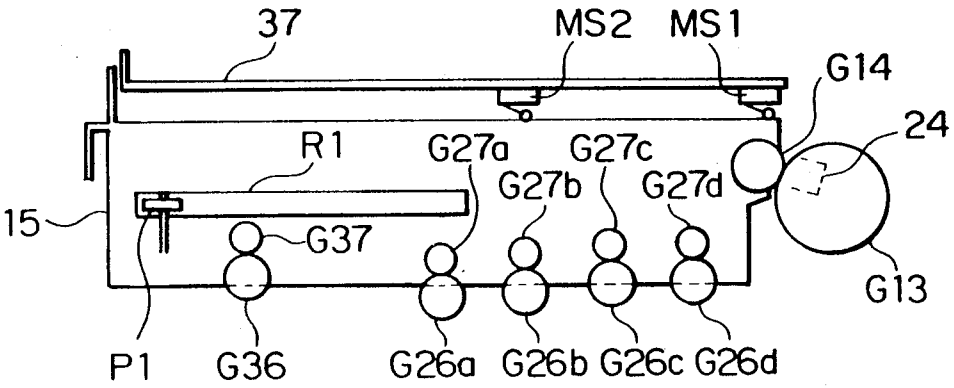
FIGS. 7(*a*), 7(*b*), and 7(*c*) illustrate the movement of the process cartridge.
Figure 7B:
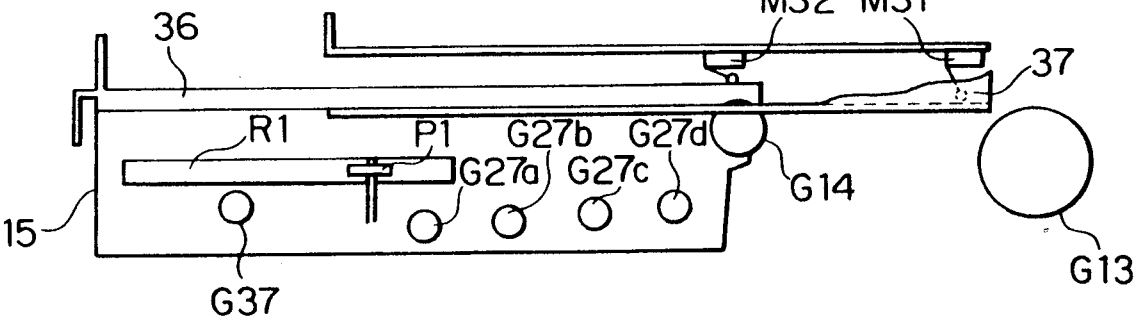
Figure 7C:
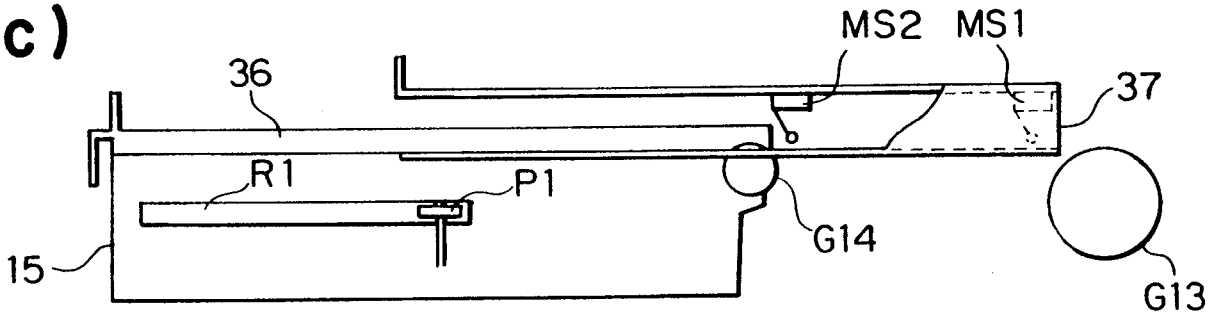

In turn, the following describes the movement of the process cartridge 15 by reference to FIG. 6 which is a cross-sectional view taken across A—A' in FIG. 1 and to FIG. 7 which illustrates the movement. The process cartridge 15 has a projection member 36 and the rack R1 to move aside, and has the gear G14, the gear G27*a* through G27*d*, and the gear G37 to make image forming. The projection member 36 may have rollers and the like provided to make easy movement.

On the other hand, the process cartridge 15 of the apparatus body 10 has a guide member 37 to guide insertion or removal thereof provided therein. (In the embodiment, the guide member 37 hangs the process cartridge 15 to guide as the projection member 36 of the process cartridge 15 is inserted.) It also has the gear G13, the gears G26*a* through G26*d*, and the gear G36 provided corresponding to the gear G14 for the process cartridge 15, the gears G27*a* through G27*d*, and the gear G34. It further has the pinion P1 arranged so that it can engage with the rack R1 provided on the process cartridge 15. The guide member 37 has microswitches MS1 and MS2 provided thereon which can detect positions of the process cartridge 15. The microswitches MS1 and MS2 respectively detect a first position at which image forming can be made when the gear G14, the gears G27*a* through G27*a*, and the gear G37 provided on the process cartridge 15 are engaged with the gear G13, the gears G26*a* through G26*d*, and the gear G36 provided on the apparatus body 10 and a second position which is separated from the transfer arrangement 24, or away from the first position, or slid in from the first position in a direction opposite to the insertion direction of the process cartridge 15. They feed the respective location signals to a control unit. It should be noted that the second position should be determined at which a center of gravity of the process cartridge 15 should be inside the apparatus body 10. The reason is that if the center of gravity is outside the apparatus body 10, the rack R1 is hard to engage with the pinion P1, resulting in difficult removal and insertion of the process cartridge 15. The position detection sensors for detecting the first and second positions may not be limited to the microswitches, but can be replaced by any of the conventional sensors, such as photoelectric switches and magnetic switches. The microswitches MS1 and MS2 may not be provided on a 37, but can be mounted on the apparatus body 10 as they should detect the first and second positions.

First, if the process cartridge 15 is taken out, the process cartridge 15 is at the first position as shown in FIG. 7(*a*). The first position is an optimum position for image forming as the photoreceptor belt 17 on the drive roller 18 and the transfer arrangement 24 keep a desirable distance (if the transfer member is a transfer drum, a proper pressure is given), and as the gear G14, the gears G27*a* through G27*a*, and the gear G37 provided on the process cartridge 15 are engaged with the drive gears, including the gear G13, the gears G26*a* through G26*d*, and the gear G36 provided on the apparatus body 10, respectively. The rack R1 provided on the process cartridge 15 also is engaged with the pinion P1 provided on the apparatus body 10.

Then, the control unit which will be described later generates a process cartridge move signal to the moving arrangement for the process cartridge 15. That is, the control unit feeds the signal to the motor M2 and the electromagnetic clutch C22 which can drive the moving arrangement for the process cartridge 15 to revolve the pinion P1 to move the process cartridge 15 along the guide member 37 from the first position to the second position (see FIG. 7(*b*)).

When the process cartridge 15 moves as shown in FIG. 7(*c*), the microswitch MS2 detects that the process cartridge 15 has moved to the second position, and feeds the signal to the control unit. When receiving the signal, the control unit releases the electromagnetic clutch C22 to stop the moving process cartridge 15 and at the same time, stops the motor M2 if this is not needed. In other words, the process cartridge 15 is stopped at the second position with the rack R1 engaged with the pinion P1, or has been slid from the first position to the second position. For clearing of jam, the process cartridge 15 should be held at the second position. At the second position, the process cartridge 15 can be demounted out of the apparatus body 10 by pulling a little to free it. It should be noted that the front cover 14 is arranged so that it will not prevent the process cartridge 15 from moving as will be described later.

Conversely, to insert the process cartridge 15 into the apparatus body 10 after the replacement, the projection member 36 of the process cartridge 15 is to be inserted along with the guide member 37 in the process cartridge 15 to make the rack R1 engage with the pinion P1 until the process cartridge 15 comes to the second position (see FIG. 7(*c*)). The process cartridge 15 then is at the second position. (After clearing of jam, it is at the position.)

In order to move the process cartridge 15 from the second position to the first position where image forming can be made, the process cartridge 15 at the second position should be further inserted, or a move signal is input from the control unit which will be described later. The signal, then, is fed to the motor M2 and the electromagnetic clutch C22 to make the pinion P1 revolve in a direction opposite to that of the removal to move the process cartridge 15 along the guide member 37 from the second position to the first position (see FIG. 7(*b*)).

When the process cartridge 15 moves, the microswitch MS1 detects that the process cartridge 15 has moved to the first position as shown in FIG. 7(*a*), and feeds the signal to the control unit. When receiving the signal, the control unit releases the electromagnetic clutch C22 to stop the process cartridge 15 at the first position and at the same time, stops the motor M2 if this is not needed. That is, the process cartridge 15 stops at the first position, and the gear G14, the gears G27*a* through G27*a*, and the gear G37 provided on the process cartridge 15 are engaged with the drive gears, including the gear G13, the gears G26*a* through G26*d*, and the gear G36 provided on the apparatus body 10, respectively, thereby allowing the image forming. At the same time, toner supply openings 38*a* through 38*d* of the developing sections 23*a* through 23*d* in the process cartridge 15 have corresponding toner feed tubes 353*a* through 353*d* of the toner hoppers 35*a* through 35*d* automatically connected therewith to allow supply of the toner.

As the front cover 14 is spring forced to close as the process cartridge 15 is moved, it will not prevent the process cartridge 15 from moving. That is, with the movement of the process cartridge 15, the front cover 14 is pressed to release. Alternatively, the spring forced front cover 14 may be checked by a solenoid so that a signal is fed to the solenoid to the front cover 14 from being checked to make the spring force open the front cover 14 at the same time when the control unit generates the signal to move the process cartridge 15. Further alternatively, it is possible that if the front cover 14 is made to open by a motor and gears, the front cover 14 cannot only be made to open when the process cartridge 15 is moved from the first position to the second position, but also the front cover 14 can be automatically closed when the microswitch MS1 detects that the process cartridge 15 has been moved to the first position from the second position.

Figures 8A, 8B, 8C:
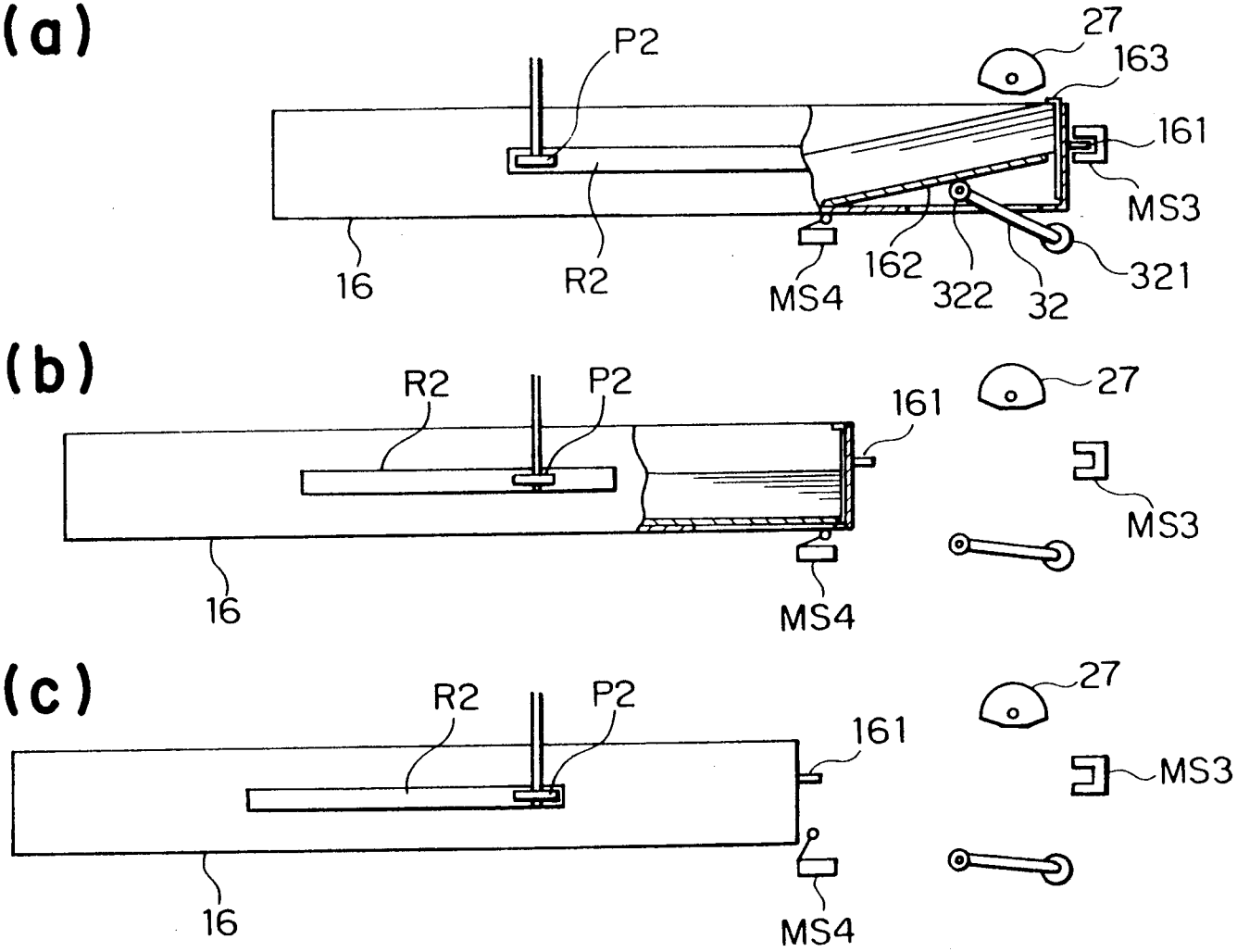
FIGS. 8(*a*), 8(*b*), and 8(*c*) illustrate the movement of the cassette.
Figures 1, 9A:
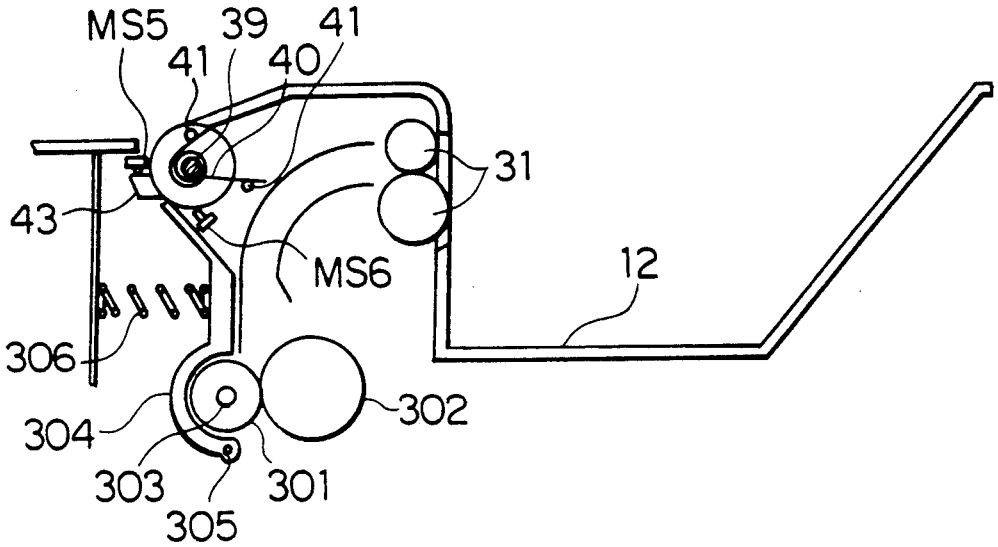
Figures 2, 9A:
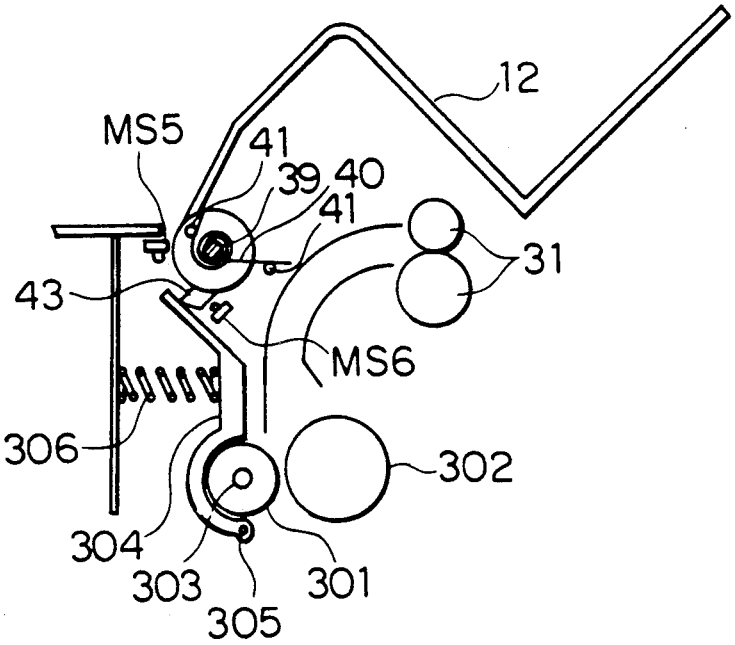
Figures 1, 9B:
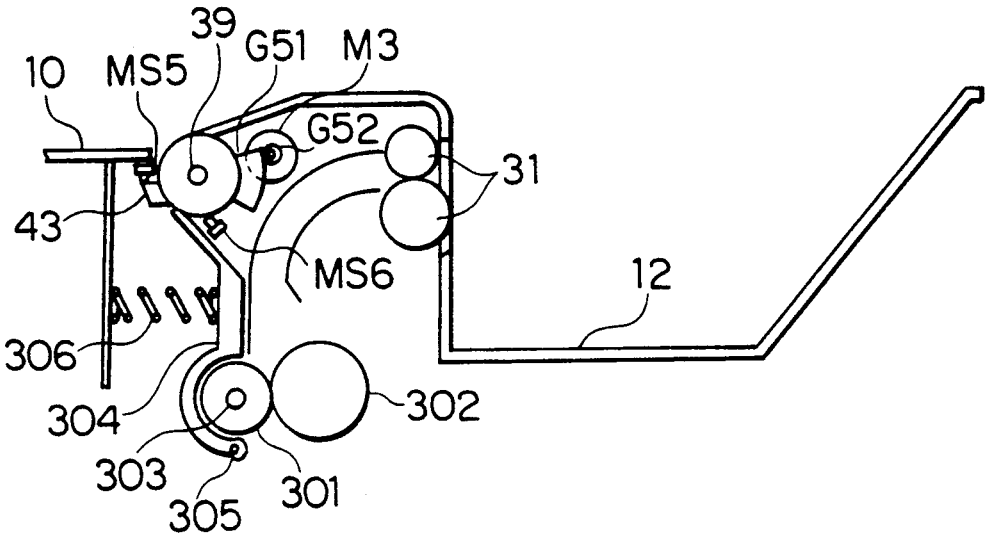
Figures 2, 9B:
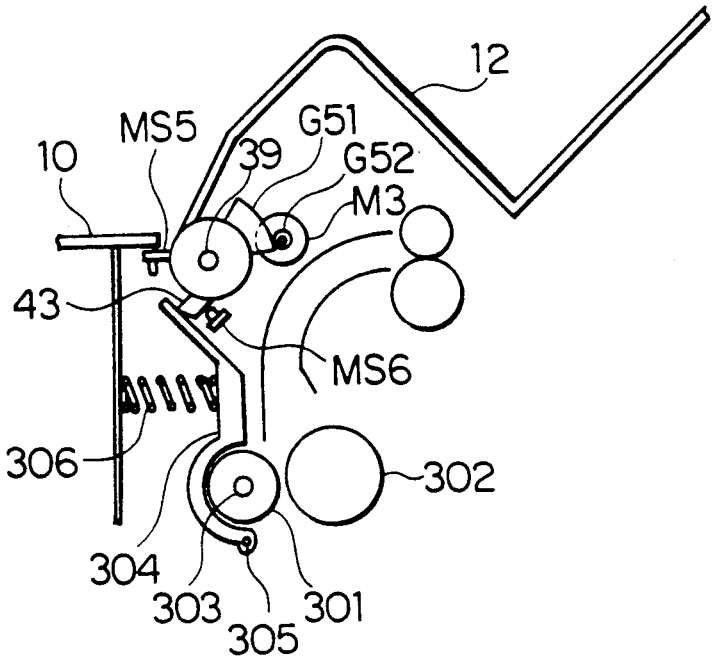

In turn, the following describes movement of the sheet feed cassette 16 by reference to the FIG. 8. The sheet feed cassette 16 has the rack R2 provided on a side thereof to move, a projection 161 provided in front thereof, and a turnable bottom plate 162 and a slidable separation pawl 163 provided therein to load the transfer material.

On the other hand, the apparatus body 10 has a sheet feed roller 27, the pinion P2 for moving the sheet feed cassette 16, a press-up lever 32 for pressing the bottom plate 162 up, a photoelectric switch MS3 of photocoupler, and a microswitch MS4 provided therein.

The press-up lever 32 is rotatably supported by a press-up device 321 provided on the apparatus body 10, and its end has a roller 322. The press-up device 321 may be made up in any of the conventional ways, such as spring, lever, and motor. It may be provided inside the sheet feed cassette 16 together with the press-up lever 32.

The microswitches MS3 and MS4 are detectors for detecting positions of the sheet feed cassette 16. The microswitches MS3 and MS4 respectively detect a first position at which paper feed can be made when the press-up lever 32 presses the top of the transfer material in the sheet feed cassette 16 and a second position which is away from the first position, or slid in from the first position in a direction opposite to the insertion direction of the sheet feed cassette 16. They feed the respective location signals to the control unit. It should be noted that the second position should be determined at which a center of gravity of the sheet feed cassette 16 should be inside the apparatus body 10 as in the process cartridge 15. The position detection sensors for detecting the first and second positions may not be limited to the ones used in the embodiment, but can be replaced by any of the conventional sensors, such as microswitches, photoelectric switches, and magnetic switches.

First, if the sheet feed cassette 16 is taken out, the sheet feed cassette 16 is at the first position as shown in FIG. 8(*a*). The first position is an optimum position for feeding the transfer material by the sheet feed roller 27. The rack R2 also is engaged with the pinion P1.

Then, the control unit which will be described later generates a cassette move signal to the moving arrangement for the sheet feed cassette 16. That is, the control unit feeds the signal to the motor M2 and the electromagnetic clutch 23 which can drive the moving arrangement for the process cartridge 15 to revolve the pinion P2 to move the sheet feed cassette 16 from the first position to the second position. In this operation, the press-up lever 32 is moved down the sheet feed cassette 16 so that it will not prevent the sheet feed cassette 16 from moving (see FIG. 8(*b*)).

When the sheet feed cassette 16 moves as shown in FIG. 8(*c*), the microswitch MS4 detects that the sheet feed cassette 16 has moved to the second position, and feeds the signal to the control unit. When receiving the signal, the control unit releases the electromagnetic clutch 23 to stop the moving sheet feed cassette 16 and at the same time, stops the motor M2 if this is not needed. In other words, the sheet feed cassette 16 is stopped at the second position with the rack R2 engaged with the pinion P2, or has been slid from the first position to the second position. At the second position, the sheet feed cassette 16 can be demounted out of the apparatus body 10 by pulling a little to clear of jam, replace it, or supply the transfer material into it.

Conversely, to insert the sheet feed cassette 16 into the apparatus body 10 after clearing of jam, replacing the sheet feed cassette 16, or supplying the transfer material, the sheet feed cassette 16 is to be inserted along its cabinet or along with its guide member (not shown) to make the rack R2 engage with the pinion P2 until the sheet feed cassette 16 comes to the second position (see FIG. 8(*c*)).

In order to move the sheet feed cassette 16 from the second position to the first position where paper feed can be made, the sheet feed cassette 16 at the second position should be further inserted, or a move signal is input from the control unit which will be described later. The signal, then, is fed to the motor M2 and the electromagnetic clutch 23 to make the pinion P2 revolve in a direction opposite to that of the removal to move the sheet feed cassette 16 along the guide member 37 from the second position to the first position (see FIG. 8(*b*)).

When the sheet feed cassette 16 moves, the photoelectric switch MS3 detects with the projection 161 that the sheet feed cassette 16 has moved to the first position as shown in FIG. 8(*a*), and feeds the signal to the control unit. When receiving the signal, the control unit releases the electromagnetic clutch 23 to stop the sheet feed cassette 16 at the first position and at the same time, stops the motor M2 if this is not needed. That is, the sheet feed cassette 16 stops at the first position, and the press-up device 321 turns the press-up lever 32 clockwise to raise the bottom plate 162 upward with the roller 322 to press the top of the transfer material loaded on the bottom plate 162 to the separation pawl 163, thereby allowing the sheet feed roller 27 to feed the transfer material (paper).

In turn, the following describes an upper cover releasing arrangement by reference to FIG. 9. The upper cover 12 is rotatably supported by a upper cover axis 39. It also is spring forced to open counterclockwise in the figure by a coil spring 40 wound around the upper cover axis 39 and two pins 41 one end of which is fixed at the apparatus body 10 and the other at the upper cover 12. There are also provided microswitches MS5 and MS6 which detect close and open of the upper cover 12, respectively. The upper cover 12 can be fastened by a fastening member (not shown) when it is closed. When the upper cover 12 is closed during the image forming process, it also serves as discharge tray for the transferred material discharged by the sheet discharge roller 31 (see FIG. 9(*a*)-1).

If an operator releases the upper cover 12 from being fastened by the fastening member for clearing of jam or the like, the spring forced upper cover 12 is released (FIG. 9(*a*)-2), and the microswitch MS6 detects that it was made open and feeds a release signal to the control unit. Conversely, if after clearing of jam, the operator closes the upper cover 12, the microswitch MS5 detects that it was closed and feeds a close signal to the control unit.

The upper cover releasing arrangement may not be limited to the one described in the embodiment, but can be replaced by a member which can be fastened to the upper cover axis 39 itself. Alternatively, any of the fastening members may be replaced by a solenoid. Further alternatively, there may be provided a gear on the upper cover axis 39 and a motor engaging the gear. The motor may be revolved by an open command from the operation panel 11 to release the upper cover 12. Conversely, the motor also can be reversely revolved by inputting a set signal from the operation panel 11 to the control unit to close the upper cover 12.

The image forming apparatus in the embodiment, as described above, is constructed so that the process cartridge 15 has the upper cover 12 provided thereabove. The apparatus, however, may not be limited to that. In the so-called clamshell type image forming apparatus, the releasing arrangement for the upper cover 12 in the embodiment can be replaced by a releasing arrangement can be provided on an upper casing. The detection devices for detecting the opening and closing of the upper cover 12 may not be limited to the microswitches, but can be replaced by any of the conventional sensors, such as photoelectric switches and magnetic switches. It is not needed to use the two microswitches, but either one of them may be used. In turn, the following describes a fixing roller pressure releasing arrangement by reference to FIG. 9(*a*). In the first embodiment, releasing the fixing roller 30 from pressure is made with use of opening and closing of the upper cover 12. There is a provided a projection 43 turning together with the upper cover 12 around the upper cover axis 39 to make it serve as cam. The fixing roller 30 is made up of a press roller 301 and a heating roller 302. The heating roller 302 is provided with a separating member (not shown) and a cleaning member (not shown) therearound, and is revolved clockwise by a drive arrangement (not shown). The press roller 301 can be revolved counterclockwise to follow the heating roller 302. A press roller axis 303 for the press roller 301 is turnably supported by a press releasing member 304. The press releasing member 304 is turnably supported on the apparatus body 10 at its one end by a press releasing axis 305, and is forced clockwise by a spring 306. The fixing roller 30 during the image forming process, as shown in FIG. 9(*a*)-1, can melt and solidify the toner image on the transfer material to carry this to the sheet discharge roller 31 as the press roller 301 presses the heating roller 302 and the heating roller 302 is heated and revolved by a heating device.

In such a pressure releasing arrangement as constructed above for the fixing roller 30, if the projection 43 is turned counterclockwise with the upper cover 12 opened, the press releasing member 304 is turned counterclockwise with the press releasing axis 305 being a fulcrum to release the press roller 301 turnably supported on the press releasing member 304 from pressing the heating roller 302. This makes clearance between the press roller 301 and the heating roller 302, allowing jamming paper in the fixing section to be removed easily.

Conversely, if the fixing roller 30 is pressed, the projection 43 is turned clockwise with the upper cover 12 closed. As the press releasing member 304 is forced by the spring 306 clockwise with the press releasing axis 305 serving as the fulcrum, the press roller 301 presses the heating roller 302. Pressing and releasing the fixing roller 30, therefore, can be made by a simple arrangement.

In the embodiment, the press roller 301 is moved to release the fixing roller 30 from pressing. It need hardly be said that the heating roller 302 can be moved to release the fixing roller 30 from pressing. The pressure releasing arrangement in the embodiment has the cam on the upper cover 12. Instead, a motor and gear, a solenoid, or similar devices are available to directly release the fixing roller 30 from pressing with use of a signal from the control unit.

Figure 10:
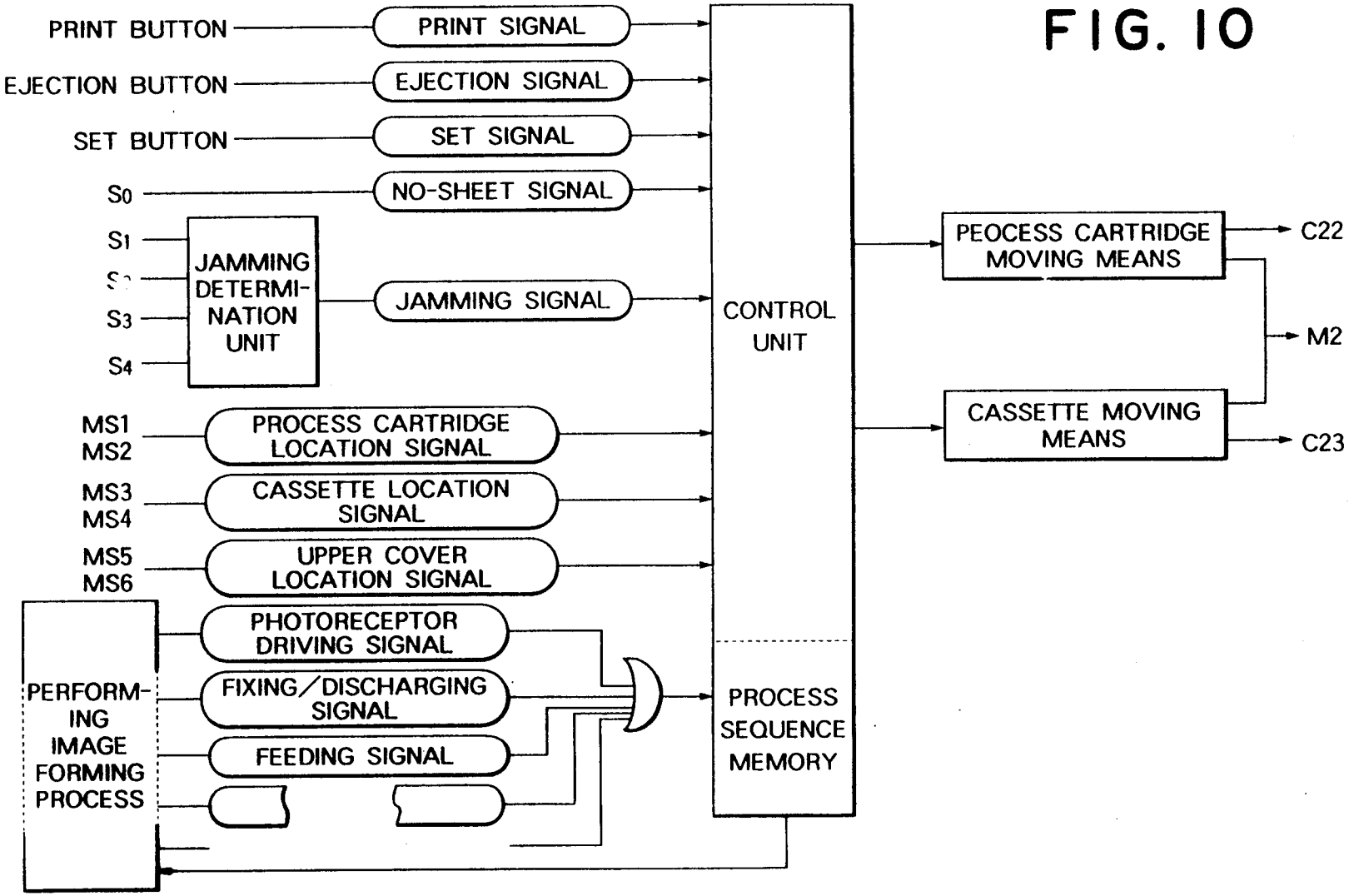
FIG. 10 is a control diagram illustrating control operations for the process cartridge movement and the cassette movement.

The moving controls for the process cartridge 15 and the sheet feed cassette 16 and the releasing control for the upper cover 12 described so far are shown in FIG. 10. If an operator opens the upper cover 12, the microswitch MS6 feeds the release signal out. The control unit having the release signal input thereto feeds the process cartridge move signal and the cassette move signal out. The process cartridge moving arrangement having the process cartridge move signal received from the control unit controls the drive system for the process cartridge moving arrangement to move the process cartridge 15 from the first position to the second position. If having a position detection signal for detecting that the process cartridge 15 has been moved to the second position, it stops the drive system for the process cartridge moving arrangement.

On the other hand, the cassette moving arrangement having the cassette move signal received from the control unit moves the sheet feed cassette 16 from the first position to the second position. In other words, as shown in FIG. 12, only releasing the upper cover 12 can automatically slide the process cartridge 15 and the sheet feed cassette 16 away to the second position, allowing jamming paper to be removed easily.

If the operator closes the upper cover 12 after clearing of jam, the control unit receives the close signal of the upper cover 12, and feeds the move signal to the process cartridge moving arrangement and the cassette moving arrangement so that these should be moved to the respective second positions. That is, only closing the upper cover 12 after clearing of jam allows the process cartridge 15 and the sheet feed cassette 16 at the second positions to be automatically put in. This cannot only save the operator's work to a great extent, but also can set the process cartridge 15 and the sheet feed cassette 16 at optimum positions.

Alternatively, in order to move the process cartridge 15 and the sheet feed cassette 16, the jam signals output of the jamming detection sensors S1 through S4 are available. In such a system, a jamming determination unit can determine whether a transfer material presence or absence signal of the jamming detection sensors S1 through S4 does mean jamming or not. If determining that is means jamming, the jamming determination unit feeds a jam location signal to the control unit. The control unit, then stops the image forming drive units, including the photoreceptor belt drive unit, the development drive unit, and the fixing drive unit, and at the same time, makes the operation panel 11 indicate occurrence of jamming. Seeing the indication, the operator should move the fastening member for the upper cover 12 to open the upper cover 12. The microswitch MS6 detects that the upper cover 12 is made open, and feeds the release signal to the control unit.

The control unit generates a move signal for the moving arrangement marked with circle as shown in FIG. 12(*a*) depending on the position at which jamming occurs. For example, the move signal is generated for the cassette moving arrangement if jamming occurs at the paper feed position (jamming detection sensor S1), for the process cartridge moving arrangement and the cassette moving arrangement if at the timing position (S2), or for the process cartridge moving arrangement if at the transfer position (S3). It, however, is not generated if jamming occurs at the discharge position (S4). Based on the moving signal, the control unit should selectively and automatically move the process cartridge 15 or the sheet feed cassette 16 according as necessity for clearing of jamming. This allows the operator to check and clear of jamming only by opening the upper cover 12 without thinking hard about jamming.

If the process cartridge 15 or the sheet feed cassette 16 have to be replaced, it can be moved by the operator at his will except when the upper cover 12 is made open as described above. For the purpose, he or she should press an ejection button on the operation panel 11. When the button is pressed, an ejection signal is input to the control unit. At this time, there should appear no print signal and image forming process signals, including the photoreceptor belt drive signal, fixing and discharge drive signal, and paper feeding signal, that indicate operations of the image forming processes of the photoreceptor belt drive unit, the fixing and discharge unit, and paper feed unit. The control unit, then, can generate the process cartridge move signal and the cassette move signal to the respective process cartridge moving arrangement and cassette moving arrangement, thereby allowing the process cartridge 15 and the sheet feed cassette 16 to move from the first position to the second position as described previously.

Conversely, if the process cartridge 15 and the sheet feed cassette 16 should be moved from their respective second position to the first position, the operator should press a set button on the operation panel 11. When the process cartridge 15 or the sheet feed cassette 16 is at the second position, the control unit generates a move signal which makes the process cartridge moving arrangement or the cassette moving arrangement move the process cartridge 15 or the sheet feed cassette 16 to the first position. In other words, when the set button is pressed, the process cartridge 15 and sheet feed cassette 16 can be set at the first positions so that the image forming apparatus can make the image processing.

The ejection button and the set button may be arranged so that both of the process cartridge 15 and the sheet feed cassette 16 can be moved at the same time. Alternatively, they may be independently provided for each of the process cartridge moving arrangement and the cassette moving arrangement.

If the S0 detects that the sheet feed cassette 16 contains no transfer material except that jamming occurs, it may be arranged so that when the control unit receives a no-sheet signal, it should output the cassette move signal which makes the sheet feed cassette 16 move from the first position to the second position.

In the image forming process in the embodiment, the color toner image should be formed on the photoreceptor belt before it should be transferred to the transfer material one at a time. Alternatively, The toner image may be superimposed onto the transfer material on the transfer drum. This can be applied to a conventional monochrome printer operating in a monochrome process.

The present invention is not limited to the non-contact developing method in which description has bee made so far, but can be applied to any of the contact developing methods.

It is intended that all drive systems contained in the foregoing embodiment and in the drawings shall be interpreted as illustrative only not as limitative of the present invention. That is, it need hardly be said that they are not limited to any of combinations of gears, clutches, and belts.

Also, the present invention shall not be limited to the projection member, the guide member, the rack, and the pinion mentioned in the embodiment for moving the process cartridge. Instead, for example, the process cartridge can be put on a tray which can be moved between the first and second positions.

Figure 13:
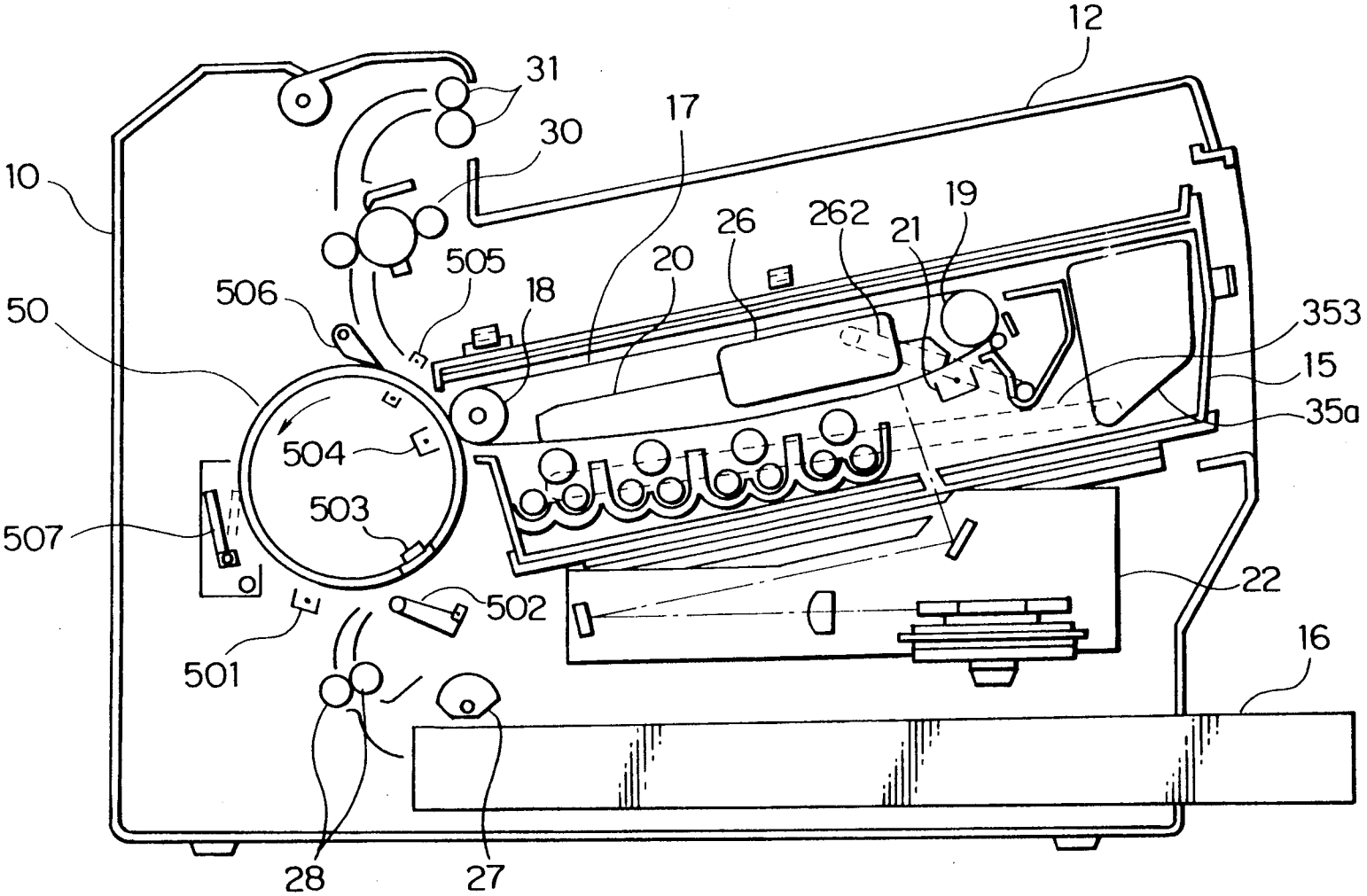
FIG. 13 is a left side view of major sections of an image forming apparatus of transfer drum type according to the present invention.

FIG. 13 is a left side view of major sections of an image forming apparatus of transfer drum type in another embodiment according to the present invention. A process cartridge 15 is the same as the one in the preceding embodiment except that a toner hopper 35a is integrated in the process cartridge 15.

In the image forming apparatus of transfer drum type, the photoreceptor belt 17 has a transfer drum 50 touched to its transfer section. The transfer drum 50 is revolved counterclockwise as synchronized with the photoreceptor belt 17. It has the transfer material wound around its surface. The wound transfer material has the color toner images formed on the photoreceptor belt 17 transferred on surface thereof one by one. The transfer material has all the color toner images registered thereon. It then is separated from the transfer drum 50, is fixed, and is discharged to the top of the apparatus body 10.

There are provided around the transfer drum 50 a charger 501 which can suck the transfer material electrostatically and a winding member 502 which can wind the transfer material mechanically. The winding member 502 has a roller at its end which touches the transfer material only at the start when the transfer material is wound on the transfer drum 50. The transfer drum 50 also has a gripper 503 on its surface which can retain an end of the transfer material carried synchronously.

A transfer arrangement 504 transfers the toner image on the photoreceptor belt 17 to the transfer material electrostatically. A separation discharge electrode 505 and a separation pawl 506 separate the transferred material from the transfer drum 50. A detouchable cleaner 507 removes the toner remaining on the transfer drum 50 having the transfer material removed.

The transfer material fed from the sheet feed cassette 16 is made to come to the transfer drum 50 charged by the charger 501 as synchronized. It was wound on the transfer drum 50 by the winding member 502. Its lead is held by the gripper 503. The transfer arrangement 504 transfers the yellow toner image formed on the photoreceptor belt 17 to the transfer material. The transfer drum 50 having completed the first transference continues revolution is cleaned by the cleaner 507, and similarly transfers the succeeding color toner images to the transference material to superimpose, including the magenta toner images at the second turn, the cyan toner image at the third turn, and the black toner image at the fourth turn. When the four color toner images are completely transferred, the transfer material is discharged by the separation discharge electrode 505. It is released from holding at its lead by the separation pawl 506, and is carried to the fixing roller 30.

The image forming apparatus in this embodiment is constructed so that the transfer drum 50 is not contained in the movable process cartridge 15 in the apparatus body 10. The process cartridge 15, therefore, can be moved similarly as in the preceding embodiment.

As described in detail so far, the image forming apparatus in the first embodiment of the present invention provides the following advantages. If the operator opens the upper cover 12, the process cartridge 15 can be automatically slid away from the position at which image forming can be made, and also the sheet feed cassette 16 can be automatically be slid away from the position at which paper can be supplied. For insertion, the process cartridge 15 and the sheet feed cassette 16 can be set to optimum positions.

As a result of the automatic movement of the process cartridge 15 and the sheet feed cassette 16 with the upper cover 12 made open in the image forming apparatus of the present invention, the operator can clear of jamming easily and lightly without any confusion. Also, as the process cartridge 15 and the sheet feed cassette 16 can be slid away from the second position for clearing of jamming, the operator can see the jamming position at a glance through an opening of the upper cover 12. Further, wide working area can be made enough to increase workability for clearing of jamming to a great extent. Further more, if removing the jamming paper, he or she cannot only scratch the image carrier, but also is free of directly touching it by hand. More over, as the process cartridge 15 is moved mechanically, it can be replaced or made to clear of jamming without being subjected to extra vibration for virtually no splash of the developing agent. This is preferable to increase maintainability.

If the image forming apparatus of the present invention is used as color printer, the operator can perform at the front all manipulations, such as removal and insertion of the process cartridge 15 and the sheet feed cassette 16, clearance of jamming, and toner supply. It, therefore, provides similar operationability and maintainability to those of the one directional manipulation of a monochrome printer.

Now, a second embodiment of the image forming apparatus of the present invention will be described below. In the second embodiment, moving the process cartridge 15 and the sheet feed cassette 16 described in the first embodiment is controlled as follows.

A jamming determination unit can determine whether a transfer material presence or absence signal of the jamming detection sensors S1 through S4 does mean jamming or not. If determining that is means jamming, the jamming determination unit feeds a jam location signal to the control unit. The control unit, then stops the image forming drive units, including the photoreceptor belt drive unit, the development drive unit, and the fixing drive unit, and at the same time, makes the operation panel 11 indicate occurrence of jamming on its display (not shown). Seeing the indication, the operator should open the upper cover 12. The microswitch MS6 detects that the upper cover 12 is made open, and feeds the release signal to the control unit.

When receiving the release signal from the microswitch MS6, the control unit generates the process cartridge move signal and the cassette move signal. The process cartridge moving arrangement having the process cartridge move signal received from the control unit controls the drive system for the process cartridge moving arrangement to move the process cartridge 15 from the first position to the second position. If having a position detection signal for detecting that the process cartridge 15 has been moved to the second position, it stops the drive system for the process cartridge moving arrangement.

Figure 11:
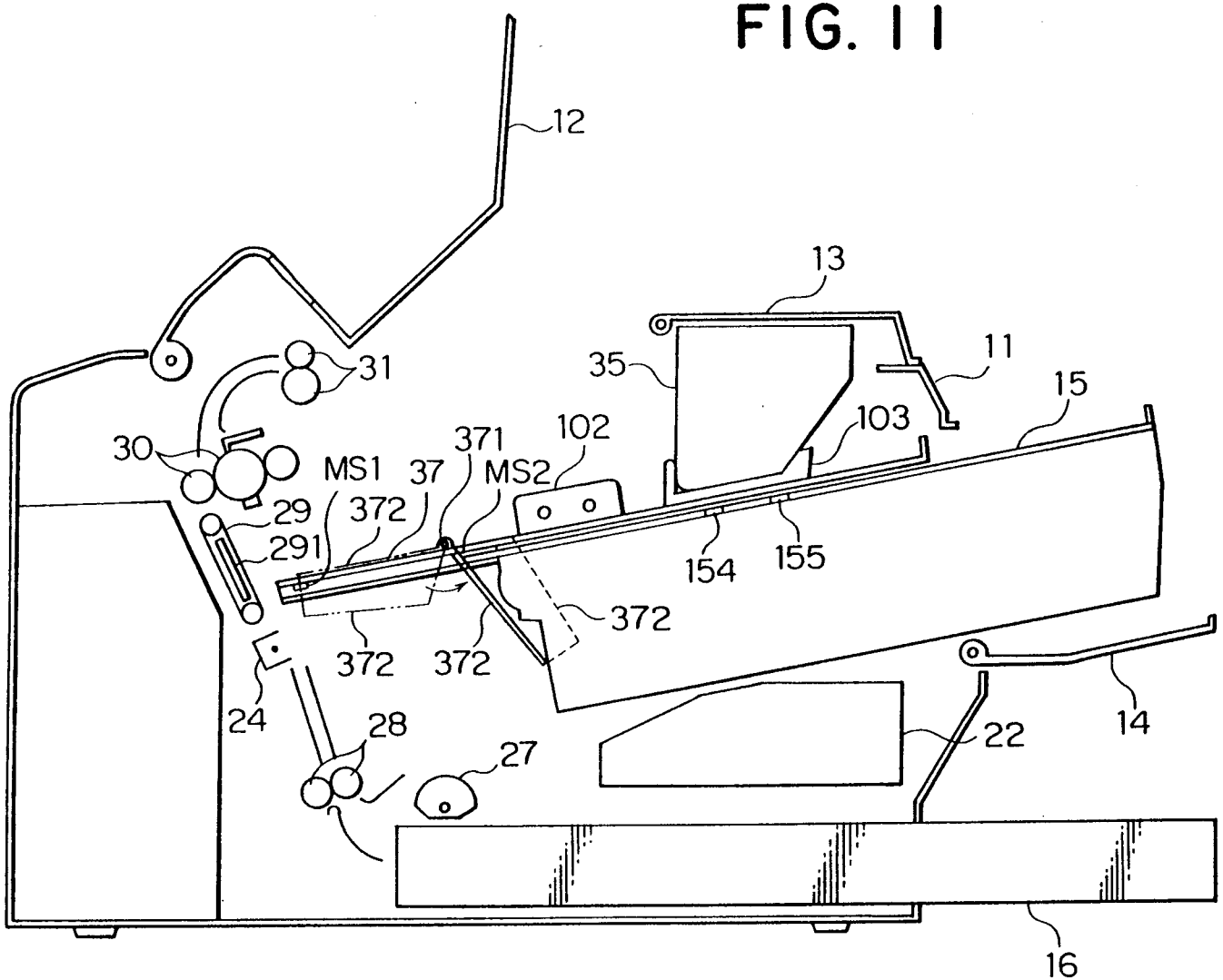
FIG. 11 is a left side view for the color printer when the process cartridge and the cassette are at a second position.

On the other hand, the cassette moving arrangement having the cassette move signal received from the control unit moves the sheet feed cassette 16 from the first position to the second position. In other words, if jamming occurs, as shown in FIG. 11, only releasing the upper cover 12 can automatically slide the process cartridge 15 and the sheet feed cassette 16 away to the second position, allowing the operator to check and remove the jamming paper easily.

If the operator closes the upper cover 12 after clearing of jam, the control unit receives the close signal of the upper cover 12 from the microswitch MS5, and feeds the move signal to the process cartridge moving arrangement and the cassette moving arrangement so that these should be moved to the respective first positions if they are at the second positions. That is, only closing the upper cover 12 after clearing of jam allows the process cartridge 15 and the sheet feed cassette 16 at the second positions to be automatically put in. This cannot only save the operator's work to a great extent, but also can set the process cartridge 15 and the sheet feed cassette 16 at optimum positions.

In the above example, the process cartridge 15 and the sheet feed cassette 16 are slid away to the second positions by opening the upper cover 12. Alternatively, the control unit generates a move signal for the moving arrangement marked with circle as shown in FIG. 12 depending on the position at which jamming occurs. For example, the move signal is generated for the cassette moving arrangement if jamming occurs at the paper feed position (jamming detection sensor S1), for the process cartridge moving arrangement and the cassette moving arrangement if at the timing position (S2), or for the process cartridge moving arrangement if at the transfer position (S3). It, however, is not generated if jamming occurs at the discharge position (S4). Based on the moving signal, the control unit should selectively and automatically move the process cartridge 15 or the sheet feed cassette 16 according as necessity for clearing of jamming. This allows the operator to check and clear of jamming only by opening the upper cover 12 without thinking hard about jamming.

If the process cartridge 15 or the sheet feed cassette 16 have to be replaced, it can be moved by the operator at his will except when the upper cover 12 is made open as described above. For the purpose, he or she should press an ejection button on the operation panel 11. When the button is pressed, an ejection signal is input to the control unit. At this time, there should appear no print signal and image forming process signals, including the photoreceptor belt drive signal, fixing and discharge drive signal, and paper feeding signal, that indicate operations of the image forming processes of the photoreceptor belt drive unit, the fixing and discharge unit, and paper feed unit. The control unit, then, can generate the process cartridge move signal and the cassette move signal to the respective process cartridge moving arrangement and cassette moving arrangement, thereby allowing the process cartridge 15 and the sheet feed cassette 16 to move from the first position to the second position as described previously.

Conversely, if the process cartridge 15 and the sheet feed cassette 16 should be moved from their respective second position to the first position, the operator should press a set button on the operation panel 11. When the process cartridge 15 or the sheet feed cassette 16 is at the second position, the control unit generates a move signal which makes the process cartridge moving arrangement or the cassette moving arrangement move the process cartridge 15 or the sheet feed cassette 16 to the first position. In other words, when the set button is pressed, the process cartridge 15 and sheet feed cassette 16 can be set at the first positions so that the image forming apparatus can make the image processing.

The ejection button and the set button may be arranged so that both of the process cartridge 15 and the sheet feed cassette 16 can be moved at the same time. Alternatively, they may be independently provided for each of the process cartridge moving arrangement and the cassette moving arrangement.

If the S0 detects that the sheet feed cassette 16 contains no transfer material except that jamming occurs, it may be arranged so that when the control unit receives a no-sheet signal, it should output the cassette move signal which makes the sheet feed cassette 16 move from the first position to the second position.

As described in detail so far, the image forming apparatus in the second embodiment of the present invention provides the following advantages. If after seeing occurrence of jamming, the operator opens the upper cover 12, the process cartridge 15 can be automatically slid away from the position at which image forming can be made, and also the sheet feed cassette 16 can be automatically be slid away from the position at which paper can be supplied. For insertion, the process cartridge 15 and the sheet feed cassette 16 can be set to optimum positions.

As a result of the automatic movement of the process cartridge 15 and the sheet feed cassette 16 with the upper cover 12 made open in the image forming apparatus of the present invention, the operator can clear of jamming easily and lightly without any confusion.

In turn, the following describes a third embodiment by reference to FIG. 9. The upper cover 12 is rotatably supported by a upper cover axis 39. There is provided on the upper cover axis 39 an additional gear G51 for opening or moving the upper cover 12 so as to turn together with it. There also is provided on a M3 arranged on the apparatus body 10 another additional gear G52 which engages with the gear G51. There further are provided location detection sensors, microswitches MS5 and MS6, which detect close and open of the upper cover 12, respectively.

When the upper cover 12 is closed during the image forming process, it also serves as discharge tray for the transferred material discharged by the sheet discharge roller 31 (see FIG. 9(*b*)-1). If the upper cover releasing signal is input to the upper cover releasing arrangement from the control unit which will be described later, or if the signal input to a M3, the M3 revolves the gears G51 through G52 counterclockwise. The upper cover 12, therefore, is made open as turned around the upper cover axis 39 counterclockwise. And, the microswitch MS6 detects that it was made open and feeds a release signal to the control unit, which stops the M3. An operator can easily find and remove jamming paper through an opening of the released upper cover 12.

Conversely, to close the upper cover 12, this is turned to closed, or it is tuned clockwise by the M3 turning (counterclockwise in the figure) with the close signal input from the control unit. If the microswitch MS5 detects that the upper cover 12 was closed, the control unit stops the M3. This means that the upper cover 12 has been closed (FIG. 9(*b*)-1). The upper cover releasing arrangement may not be limited to the one described in the embodiment, but can have an additional fastening member which can fasten the upper cover 12 which is spring forced toward the release direction. The upper cover 12 should be made to open with the release signal from the control unit to release the fastening member.

The image forming apparatus in the embodiment, as described above, is constructed so that the process cartridge 15 has the upper cover 12 provided thereabove. The apparatus, however, may not be limited to that. In the so-called clamshell type image forming apparatus, the releasing arrangement for the upper cover 12 in the embodiment can be replaced by a releasing arrangement can be provided on an upper casing.

In turn, the following describes a fixing roller pressure releasing arrangement by reference to FIG. 9(*b*). In the first embodiment, releasing the fixing roller 30 from pressure is made with use of opening and closing of the upper cover 12. There is a provided a projection 43 turning together with the upper cover 12 around the upper cover axis 39 to make it serve as cam. The fixing roller 30 is made up of a press roller 301 and a heating roller 302. The heating roller 302 is provided with a separating member (not shown) and a cleaning member (not shown) therearound, and is revolved clockwise by a drive arrangement (not shown). The press roller 301 can be revolved counterclockwise to follow the heating roller 302. A press roller axis 303 for the press roller 301 is turnably supported by a press releasing member 304. The press releasing member 304 is turnably supported on the apparatus body 10 at its one end by a press releasing axis 305, and is forced clockwise by a spring 306. The fixing roller 30 during the image forming process, as shown in FIG. 9(*b*)-1, can melt and solidify the toner image on the transfer material to carry this to the sheet discharge roller 31 as the press roller 301 presses the heating roller 302 and the heating roller 302 is heated and revolved by a heating device.

In such a pressure releasing arrangement as constructed above for the fixing roller 30, if the projection 43 is turned counterclockwise with the upper cover 12 opened, the press releasing member 304 is turned counterclockwise with the press releasing axis 305 being a fulcrum to release the press roller 301 turnably supported on the press releasing member 304 from pressing the heating roller 302. This makes clearance between the press roller 301 and the heating roller 302, allowing jamming paper in the fixing section to be removed easily.

Conversely, if the fixing roller 30 is pressed, the projection 43 is turned clockwise with the upper cover 12 closed. As the press releasing member 304 is forced by the spring 306 clockwise with the press releasing axis 305 serving as the fulcrum, the press roller 301 presses the heating roller 302. Pressing and releasing the fixing roller 30, therefore, can be made by a simple arrangement.

In the embodiment, the press roller 301 is moved to release the fixing roller 30 from pressing. It need hardly be said that the heating roller 302 can be moved to release the fixing roller 30 from pressing. The pressure releasing arrangement in the embodiment has the cam on the upper cover 12. Instead, a motor and gear, a solenoid, or similar devices are available to directly release the fixing roller 30 from pressing with use of a signal from the control unit.

As described above, the moving controls for the process cartridge 15 and the sheet feed cassette 16 and the releasing control for the upper cover 12 are shown in FIG. 10. A jamming determination unit can determine whether a transfer material presence or absence signal of the jamming detection sensors Sl through S4 does mean jamming or not. If determining that is means jamming, the jamming determination unit feeds a jam location signal to the control unit. The control unit, then stops the image forming drive units, including the photoreceptor belt drive unit, the development drive unit, and the fixing drive unit, and at the same time, makes the operation panel 11 indicate occurrence of jamming on its display (not shown). It, further, outputs the process cartridge move signal, the cassette move signal, and the upper cover release signal to the process cartridge moving arrangement, the cassette moving arrangement, and the upper cover releasing arrangement, respectively. The process cartridge moving arrangement having the process cartridge move signal received from the control unit controls the drive system for the process cartridge moving arrangement to move the process cartridge 15 from the first position to the second position. If having a position detection signal for detecting that the process cartridge 15 has been moved to the second position, it stops the drive system for the process cartridge moving arrangement. On the other hand, the cassette moving arrangement having the cassette move signal received from the control unit moves the sheet feed cassette 16 from the first position to the second position. The upper cover releasing arrangement having the releasing signal received from the control unit releases the upper cover. In other words, if jamming occurs, as shown in FIG. 11, the process cartridge 15 and the sheet feed cassette 16 are automatically moved to the second position, and the upper cover 12 is made open, allowing the operator to see the jamming position at a glance through an opening of the upper cover 12. Further, wide working area can be made enough to increase workability for clearing of jamming to a great extent. The above described movement may be made to start right after jamming occurs. Alternatively, the operator may press a check button or the like to check it before the automatic movement is made.

After clearance of jamming, the process cartridge 15 at the second position is inserted toward the first position, or The sheet feed cassette 16 at the second position is inserted a little, or the released upper cover 12 is turned to close. In any of these operations, the control unit controls the process cartridge moving arrangement, the cassette moving arrangement, and the upper cover releasing arrangement. In this case, only if the process cartridge 15 or the sheet feed cassette 16 is at the second position, it is moved to the first position. (If it is at the first position, it is remained there.) Only if the upper cover 12 is open, it is closed. (if it is closed, it is remained still.) Simple manipulation, therefore, allows the image forming states to be set, or setting the process cartridge 15 and the sheet feed cassette 16 to the first position and closing the upper cover 12 are automatically made. This cannot only save the operator's troublesome work to a great extent, but also can set the process cartridge 15 and the sheet feed cassette 16 at optimum positions.

In the above embodiment, with occurrence of jamming, the process cartridge 15, the sheet feed cassette 16, and the upper cover 12 are all moved. Alternatively, the control unit may control the process cartridge moving arrangement, the cassette moving arrangement, and the upper cover releasing arrangement depending on the position of occurrence of jamming. That is, the control unit generates a move signal for the moving arrangement marked with circle as shown in FIG. 12 depending on the position at which jamming occurs. For example, the move signal is generated for the cassette moving arrangement if jamming occurs at the paper feed position (jamming detection sensor S1), for the process cartridge moving arrangement, the cassette moving arrangement, and the upper cover releasing arrangement if at the timing position (S2), for the process cartridge moving arrangement and the upper cover releasing arrangement if at the transfer position (S3), or for the upper cover releasing arrangement if jamming occurs at the discharge position (S4). Thus, the control unit should control the process cartridge moving arrangement, the cassette moving arrangement, and the upper cover releasing arrangement depending on the jamming position. This allows any of the arrangements needed to clear of jamming to be slid away or released. The operator, therefore, can assuredly find the jamming position, easily check the jamming paper, and clear it fully.

If the process cartridge 15 or the sheet feed cassette 16 have to be replaced, it can be moved by the operator at his will except when jamming happens as described above. For the purpose, he or she can press an ejection button on the operation panel 11 to move the process cartridge 15 and the sheet feed cassette 16 and to release the upper cover 12. When the button is pressed, an ejection signal is input to the control unit. At this time, there should appear no print signal and image forming process signals, including the photoreceptor belt drive signal, fixing and discharge drive signal, and paper feeding signal, that indicate operations of the image forming processes of the photoreceptor belt drive unit, the fixing and discharge unit, and paper feed unit. The control unit, then, can generate the process cartridge move signal, the cassette move signal, and the upper cover release signal to the respective process cartridge moving arrangement, cassette moving arrangement, and the upper cover releasing arrangement even if the jamming signal is not input to the control unit, thereby allowing the process cartridge 15 and the sheet feed cassette 16 to move from the first position to the second position and the upper cover 12 to open as described previously.

Conversely, if the process cartridge 15 and the sheet feed cassette 16 should be moved from their respective second position to the first position and if the upper cover 12 should be closed, the operator should press a set button on the operation panel 11. When the process cartridge 15 or the sheet feed cassette 16 is at the second position or when the upper cover 12 is open, the control unit generates a move signal which makes the process cartridge moving arrangement or the cassette moving arrangement move the process cartridge 15 or the sheet feed cassette 16 to the first position, or generates a releasing signal which makes the open upper cover 12 close. In other words, when the set button is pressed, the process cartridge 15 and sheet feed cassette 16 can be set at the first positions and the upper cover 12 can be closed so that the image forming apparatus can make the image processing.

The ejection button and the set button may be arranged so that all of the process cartridge 15, the sheet feed cassette 16, and the upper cover 12 can be moved at the same time. Alternatively, they may be independently provided for each of the process cartridge moving arrangement, the cassette moving arrangement, and the upper cover releasing arrangement.

If the S0 detects that the sheet feed cassette 16 contains no transfer material except that jamming occurs, it may be arranged so that only the sheet feed cassette 16 can be moved.

As described in detail so far, the image forming apparatus in the third embodiment of the present invention provides the following advantages. If jamming happens, the process cartridge 15 can be automatically slid away from the position at which image forming can be made, the sheet feed cassette 16 can be automatically be slid away from the position at which paper can be supplied, and the upper cover 12 can be made open. For insertion, the process cartridge 15 and the sheet feed cassette 16 can be set to optimum positions.

As a result of the automatic movement of the process cartridge 15 and the sheet feed cassette 16 and the automatic opening of the upper cover 12 with detection of jamming in the image forming apparatus of the present invention, the operator can clear of jamming easily and lightly without any confusion. In the above described first to third embodiments of the present invention, at least one of a periodical maintenance command, material supply commands, a waste toner full indication, and trouble indications can be given on the display of the operation panel 11 as message, and the arrangements corresponding to the message can be moved as interlocked with it. Trouble shooting then can be made easily and securely.

If jamming happens or if the process cartridge 15 is to be replaced, first it is detected as trouble to stop the image forming trouble. The operation panel 11 then has the message corresponding it flashed to indicate thereon. At the same time, as shown in FIG. 11, it is interlocked with the process cartridge 15 so that this can be slid away to the second position, the upper cover 12 can be made open, and the unit arrangement having jamming happened therein can be indicated by flashing with arrow, signal, or the like. This allows the operator to check and remove the jamming transfer material from the top of the apparatus body 10.

If the photoreceptor belt 17 ends its service life, the corresponding signal is indicated on the operation panel 11 and at the same time, a removal signal for the process cartridge 15 flashes directly. The process cartridge 15 at the second position, then, can be easily taken out by pulling it a little to replace.

In addition, a toner supply signal, a waste toner full signal, or a no-sheet signal for the sheet feed cassette 16 can be indicated on the operation panel 11. At the same time, signals interlocked with them can be directly flashed on the toner hopper 35, the waste toner collection box 26, and sheet feed cassette 16, respectively. This, indeed, allows the operator to intuitively shoot the trouble.

The waste toner collection box 26 located at the rear of the process cartridge 15 is projected out of the apparatus body 10 when the process cartridge 15 is away at the second position. The operator can easily remove the waste toner collected in the waste toner collection box 26 and all.

As described above, any trouble is directly indicated on the operation panel 11 and at the same time, an arrangement to be measured, such as the process cartridge 15, the sheet feed cassette 16, or the upper cover 12, is interlocked with it to move or open. In addition, the toner hopper 35 or the waste toner collection box 26 has the direct signal flashed thereon. These features provide more simple and secure manipulation to shoot trouble.

The advantages of the present invention are achieved through such constructions as describe above. They consist in particular in the fact that any trouble can be directly indicated on the operation panel 11 and at the same time, an arrangement to be measured, such as the process cartridge 15, the sheet feed cassette 16, or the upper cover 12, can be interlocked with it to move or open. In addition, the toner hopper 35 or the waste toner collection box 26 has the direct signal flashed thereon. These advantages provide more simple and secure manipulation to shoot trouble.

Further, in the first to third embodiment, the integrated image forming apparatus can be constructed so that the slidably arranged process cartridge 15 containing the image carrier can be interlocked to move to a certain degree with trouble occurrence in the transfer material being carried, and the upper cover 12 can be interlocked to open with it, or a service call signal can be generated in terms of a movement frequency of the process cartridge 15 and a release frequency of the upper cover 12. The process cartridge 15, therefore, can be moved or replaced with a few manipulations. If troubles, such as feed malfunction, happen, even a new comer can make trouble shooting easily and securely.

Operation data can be automatically accumulated so that the service call can be automatically made on the basis of the data. For this, the movement frequency of the process cartridge 15 and the release frequency of the upper cover 12 should be stored in the control unit. If the frequencies for certain times of image forming reach specific number of times, then the control unit should determine that the apparatus has been misadjusted or any of the component arrangements has malfunctioned, thereby generating the service call signal.

The advantages of such a construction of the image forming apparatus of the present invention as described above consist in particular in the fact that with the detection signals, including the trouble occurrence signal, the service life signal, or the waste toner full signal, the process cartridge 15 can be interlocked to slide away from the position where image forming can be made and at the same time, the upper cover 12 can be also interlocked to open, and that the flashing signal can be directly fed to the arrangement to be measured, thereby allowing easy and secure trouble shooting.

In addition, it is advantageous that as the movement frequency of the process cartridge 15 and the release frequency of the upper cover 12 can be stored, the service call signal can be generated immediately when the frequencies reach certain times for specific number of times of image forming. This advantage allows the operator to make service call quickly without any hesitation.

In any of the embodiments of the present invention, the process cartridge 15 is arranged so that it can be moved horizontally or at a little angle. Such a movement direction is advantageous in that the operator is kept very safe and workable for putting in or out the process cartridge 15. Such an arrangement also is advantageous in that the process cartridge 15 will not flow over or splash the toner from its toner hopper 35 even if the toner hopper 35 is separated from the developing assembly 23 in motion, as will be described below.

The toner cartridge can be automatically disconnected and closed with shutter at the joint when being moved (not shown). As the cartridge is leveled or virtually leveled, it is advantageous that the toner will not be flown over from the openings of the developing sections. The process cartridge 15, therefore, can be automatically put in with a few manipulations after replacement of the process cartridge 15 or clearing of jamming. This cannot only save the operator's annoying work to a great extent, but also can securely set the process cartridge 15 at optimum position. That is, as the process cartridge 15 is mechanically moved horizontally or at a little angle, it can be replaced or made to clear of jamming without being subjected to extra vibration for virtually no splash of the developing agent. This is preferable to increase maintainability.

What is claimed is:

1. An image forming apparatus for forming an image from corresponding image signals, comprising:

holding means for holding a latent image corresponding to said image signals;

developing means for developing said latent image on said holding means so that a developed image is formed on said holding means;

transfer means for transferring said developed image on to a recording sheet at a transfer region;

cleaning means for cleaning a residual toner remaining on said holding means after said developed image is transferred on to said recording sheet;

enclosing means removably mounted in said image forming apparatus by an operator, for enclosing at least one of said holding means, said developing means, and said cleaning means;

cover means for covering said apparatus, said cover means having a closed position and an open position;

first detecting means for detecting said open position of said cover means, and for generating an open cover signal; and moving means connected to said first detection means and said enclosing means for automatically moving said enclosing means in a given direction between a first position, where said enclosing means is in said image forming apparatus whereby said image forming apparatus is operational, and a second position, where at least a portion of said enclosing means is outside said image forming apparatus to thereby facilitate removal of said enclosing means from said image forming apparatus by said operator; and said moving means automatically moving said enclosing means to said second position when said moving means receives said open cover signal from said first detecting means indicating that the cover means is in the open position.

2. The apparatus of claim 1, wherein said enclosing means is removable from the image forming apparatus by further movement of said enclosing means in a direction corresponding to said given direction by said operator.

3. The apparatus of claim 1, further comprising:

ejection signal generating means for generating an ejection signal upon a command of said operator; and wherein said moving means moves said enclosing means to said second position in said given direction when said moving means receives said ejection signal.

4. The apparatus of claim 1, further comprising:

second detecting means for detecting said closed position of said cover means, said second detecting means generating a closed cover position signal when said cover means is in the closed position; and detection signal generating means for generating a first detection signal when the operator moves said enclosing means to said second position;

wherein said moving means automatically moves said enclosing means to said first position when said moving means receives both said closed cover position signal and said first detection signal.

5. The apparatus of claim 1, further comprising:

recording sheet storage means for storing at least one recording sheet, said recording sheet storage means being removable from said image forming apparatus by said operator, by further movement of said recording sheet storage means in a direction corresponding to said given direction;

recording sheet storage moving means for automatically moving said recording sheet storage means between a feeding position, where said recording sheet can be fed to said image forming apparatus, and a dismount position;

jam detection means for detecting a recording sheet jam in said image forming apparatus, and for generating a jamming signal in response to a detected jam; and wherein said moving means for moving the enclosing means automatically moves said enclosing means to said second position and said recording sheet storage moving means automatically moves said recording sheet storage means to said dismount position in response to receipt of both said open cover signal and said jamming signal thereby facilitating clearing of the jam.

6. The apparatus of claim 5, wherein said recording sheet storage moving means automatically moves said recording sheet storage means in said given direction in which said moving means for moving the enclosing means moves said enclosing means.

7. The apparatus of claim 5, wherein:

said recording sheet storage moving means moves said storage sheet storage means in the given direction to the dismount position; and wherein said recording sheet storage means is removable from said image forming apparatus by said operator further moving said recording sheet storage means in the given direction.

8. The apparatus of claim 5, further comprising:

movement signal generating means for generating a movement moves said enclosing means and said recording sheet storage moving means moves said recording sheet storing means in response to said movement signal.

9. The apparatus of claim 1, wherein said moving means automatically moves said enclosing means to a position which is spaced apart from said transfer region, in response to the open cover signal, to thereby facilitate clearing of paper jams in the transfer region.

* * * * *